US006371670B1

(12) United States Patent
Kojo

(10) Patent No.: US 6,371,670 B1
(45) Date of Patent: Apr. 16, 2002

(54) LABEL PRINTING APPARATUS

(75) Inventor: Takashi Kojo, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/381,602

(22) PCT Filed: Feb. 5, 1999

(86) PCT No.: PCT/JP99/00513

§ 371 Date: Sep. 22, 1999

§ 102(e) Date: Sep. 22, 1999

(87) PCT Pub. No.: WO99/39912

PCT Pub. Date: Aug. 12, 1999

(30) Foreign Application Priority Data

Feb. 6, 1998 (JP) ..... 10-025263

(51) Int. Cl.[7] ..... B41J 2/315
(52) U.S. Cl. ..... 400/120.01; 400/621
(58) Field of Search ..... 400/120.01, 120.02, 400/621, 613, 611

(56) References Cited

U.S. PATENT DOCUMENTS 5,401,110 A * 3/1995 Neeley ..... 400/621
5,562,353 A 10/1996 Handa et al. ..... 400/120.02
5,636,926 A 6/1997 Yamaguchi ..... 400/120.02
5,823,694 A * 10/1998 Ikegami ..... 400/621
5,885,016 A * 3/1999 Toyosawa et al. ..... 400/621
6,030,135 A * 2/2000 Imai ..... 400/621
6,050,734 A * 4/2000 Watanabe et al. ..... 400/621

FOREIGN PATENT DOCUMENTS

EP 0 760 291 A2 3/1997

* cited by examiner

*Primary Examiner*—John S. Hilten
*Assistant Examiner*—Anthony H. Nguyen
(74) *Attorney, Agent, or Firm*—Frishauf, Holtz, Goodman, Langer & Chick, P.C.

(57) ABSTRACT

A label printing apparatus is provided into which a configuration of a label-affix object and a value defining the configuration, for example a value of a diameter in a case of a circular cylinder, are input. In accordance with an operational expression of the input value of the diameter and a length of an outer circumference of the input configuration, a length of a label to be wound around an outer circumference of the label-affix object is calculated. Feeding a tape by the length from a tape cassette, a printing is performed to the tape so that respective characters of a string of characters or symbols such as a name separately input are evenly arranged in the determined length. Therefore, in accordance with the outer circumference of the label-affix object, the length of the label can be automatically set up for the printing. Further, an overlap allowance is added, as necessary.

7 Claims, 19 Drawing Sheets

FIG.9

| OBJECT CONFIGURATION NOS. | OPERATIONAL EXPRESSIONS |
|---|---|
| 1 | $Z = 3 \times \frac{2}{\sqrt{3}} H1$ |
| 2 | $Z = 4H2$ |
| 3 | $Z = \frac{H3}{\sqrt{3}}$ |
| 4 | $Z = \pi H4$ |
| 5 | $Z = 2(H5+H6)$ |

FIG.10

| OBJECT CONFIGURATION | MEASURING DIMENSIONS |
|---|---|
| REGULAR TRIANGULAR PRISM | H1 |
| REGULAR QUADRANGULAR PRISM | H2 |
| REGULAR HEXAGONAL PRISM | H3 |
| CIRCULAR CYLINDER | H4 |
| OBLATE FORM | H6 H5 |

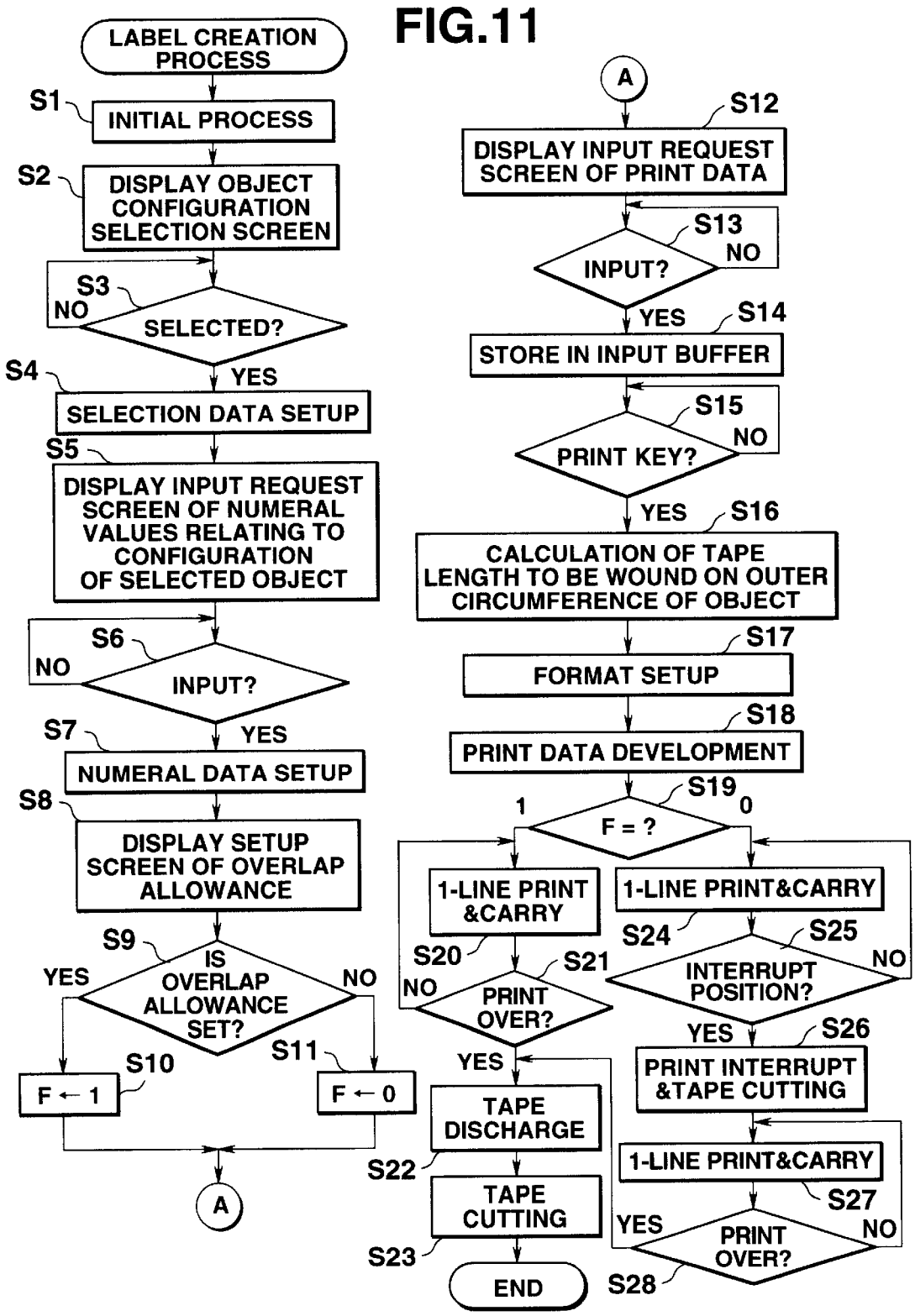
FIG.11
LABEL CREATION PROCESS
S1
INITIAL PROCESS
S2
DISPLAY OBJECT CONFIGURATION SELECTION SCREEN
S3
SELECTED?
NO
YES
S4
SELECTION DATA SETUP
S5
DISPLAY INPUT REQUEST SCREEN OF NUMERAL VALUES RELATING TO CONFIGURATION OF SELECTED OBJECT
S6
INPUT?
NO
YES
S7
NUMERAL DATA SETUP
S8
DISPLAY SETUP SCREEN OF OVERLAP ALLOWANCE
S9
IS OVERLAP ALLOWANCE SET?
YES
NO
S10
F ← 1
S11
F ← 0
A
A
S12
DISPLAY INPUT REQUEST SCREEN OF PRINT DATA
S13
INPUT?
NO
YES
S14
STORE IN INPUT BUFFER
S15
PRINT KEY?
NO
YES
S16
CALCULATION OF TAPE LENGTH TO BE WOUND ON OUTER CIRCUMFERENCE OF OBJECT
S17
FORMAT SETUP
S18
PRINT DATA DEVELOPMENT
S19
F = ?
1
0
1-LINE PRINT &CARRY
S20
S21
PRINT OVER?
NO
YES
TAPE DISCHARGE
S22
TAPE CUTTING
S23
END
1-LINE PRINT&CARRY
S24
S25
INTERRUPT POSITION?
NO
YES
S26
PRINT INTERRUPT &TAPE CUTTING
1-LINE PRINT&CARRY
S27
PRINT OVER?
YES
NO
S28

FIG.23

| CHARACTER ORDER OF INPUT CHARACTER ARRAY | CHARACTER ORDER OF OUTPUT CHARACTER ARRAY |
|---|---|
| 1 | 8 |
| 2 | 5 |
| 3 | 7 |
| 4 | 1 |
| 5 | 4 |
| 6 | 2 |
| 7 | 6 |
| 8 | 3 |

FIG.24

| ORDER | INPUT | OUTPUT |
|---|---|---|
| 1 | G | T |
| 2 | 0 | S |
| 3 | S | F |
| 4 | T | 0 |
| 5 | 0 | 0 |
| 6 | S | 6 |
| 7 | 6 | S |
| 8 | F | G |

LABEL PRINTING APPARATUS

TECHNICAL FIELD

The present invention relates to a label printing apparatus for printing a string of character or symbol on a tape to thereby create a label, and in particular, to a label printing apparatus for creating a label to be wound/affixed around an object.

BACKGROUND ART

Conventionally, there have been developed label printing apparatuses, in which a string of an arbitrary character or symbol input from a key board was printed on a long-size tape-like sealing paper (hereinafter called "printing tape" or simply "tape"), and a printed part of the tape was cut out to create a seal label.

In the conventional tape printing devices, it is assumed that a created label should be affixed on a particular flat face of an object. Thus, it was difficult to create such a label as would make a round, to be wound, about a bar-like (column-like) object, for example a mechanical pencil or a pencil.

That is, for creation of a label that should make a round about an object such as a pencil, a length around the object of affix had to be measured to determine a length of the label. Further, it was necessary for accommodation within the determined length to determine the number of characters or symbols, as well as the size of characters or symbols to be printed.

However, the measurement of a length around a solid object was troublesome and complicated for the user, and it was difficult to create a label exactly correct in length.

Further, it was difficult to create an elaborate label, such as a label having a character string to be arrayed uniformly in orientation, when spirally wound to be affixed around an object.

DISCLOSURE OF INVENTION

Accordingly, it is an object of the present invention to provide a label printing apparatus for creating a label to be wound/affixed around an object, as a printed part to be cut out after a printing on an adequate length of part of a printing tape, wherein the label printing apparatus automatically determines a length of the label in accordance with a configuration of the target object and a numeral value on a configuration-depending characteristic defining the configuration, and wherein the label printing apparatus makes a printing such as for characters or symbols to be printed in an adequately arranging manner within the length.

It is another object of the present invention to provide a label printing apparatus adapted for creation of a variety of labels to be used by winding on an object.

According to a first aspect of the present invention, there is provided a label printing apparatus for printing a string of characters or symbols on a tape to create a label to be wound to be affixed on an object, the label printing apparatus comprising character input means for inputting a string of characters or symbols to be printed on the tape, carrying means for carrying the tape, a printing head for printing in a longitudinal direction of the tape the string of characters or symbols input from the character input means, first information input means for inputting information on a configuration of the object, second information input means for inputting particular size information in accordance with the input configuration of the object, calculation means for calculating a length of the label to be wound around an outer circumference of the object in accordance with the configuration information input from the first information input means and the particular size information input from the second information input means, and printing control means for driving the carrying means and the printing head to print, on the tape, the string of characters or symbols input from the character input means with the length calculated by the calculation means.

According to the label printing apparatus, simply by inputting information on a configuration of an object and particular size information in accordance with the configuration, a string of characters or symbols can be printed on a tape in accordance with a length of an outer circumference of the object, and an adequate length of label to be used by winding on the outer circumference of the object can be created with ease.

Further, it may preferably be constituted so that a label created by the label printing apparatus is provided with an overlap allowance. Thereby, an end of the label becomes hard to peel, when affixed to the object.

Further, the calculation means may preferably be constituted with storage means for storing in advance information on a plurality of kinds of configurations of the object, and operational expressions for calculating the length of the label to be wound on the outer circumference of the object in dependence on the length information according to the information on the configurations. By use of the operational expressions stored in the storage means, the length of the label to be wound on the outer circumference of the object can be determined with ease.

Further, the printing control means may preferably be constituted so as to evenly allot respective characters or symbols input from the character input means within a range of the length determined by the calculation means, thereby allowing an attractive printing to be achieved.

Further, the firs t information input means may preferably be constituted with measurement means for measuring the object to take in the particular size information. Thereby, an input operation can be automatic.

Next, according to a second aspect of the present invention, there is provided a label printing apparatus for printing a string of characters or symbols on a tape to create a label to be spirally wound to be affixed at a predetermined winding pitch on a cylindrical object, the label printing apparatus comprising character input means for inputting a character or symbol to be printed on the tape, carrying means for carrying the tape, a printing head for printing in a longitudinal direction of the tap e a string of characters or symbols input from the character input means, detection means for detecting a width of the tape, size input means for inputting a diameter of the object, angle setting means for setting a winding angle of the label relative to the object based on the width of the tape detected by the detection means, the diameter of the object input from the size input means, and the predetermined winding pitch, calculation means for calculating a character pitch of the characters or symbols input from the character input means based on the winding angle set by the angle setting means, and printing control means responsive to the winding angle set by the angle setting means, for rotating respective characters or symbols of the character array input from the character input means, and for setting up the character pitch calculated by the calculation means, and driving the carrying means and the printing head, to print on the tape the string of characters or symbols input from the character input means.

According to this label printing apparatus, a label can be printed for arrangement of a string of input characters or symbols in an axial direction of the outer circumference of the cylindrical object.

Since the position of the string of characters or symbols to be arranged is in the axial direction of the outer circumference of the object, the string of characters or symbols can be presented over a relatively long distance, with a large character size, and in a state easy to observe. Further, the label can be wound by rounds about the object, and hardly peels.

In the label printing apparatus, the angle setting means may preferably be constituted with storage means for storing in advance data on winding angles of the label corresponding to width of the tape, diameter of the object, and the predetermined winding pitch. The data of the storage means can be used to facilitate a printing process.

Further, according to a third aspect of the present invention, there is provided a label printing apparatus for printing a string of characters or symbols on a tape made of a transparent material to create a label to be wound in layers on a cylindrical object having a predetermined diameter, the label printing apparatus comprising character input means for inputting a string of characters or symbols to be printed on the tape, carrying means for carrying the tape, a printing head for printing in a longitudinal direction of the tape the string of characters or symbols input from the character input means, conversion means for converting an order of the string of characters or symbols input from the character input means, character pitch setup means for setting up a character pitch of the characters or symbols so that, when the label is wound in layers on the object, the string of characters or symbols having an order converted by the conversion means is arrayed in the order when the string of characters or symbols is input from the character input means, and printing control means for driving the carrying means and the printing head to print on the tape the string of characters or symbols having the order converted by the conversion means, in accordance with the character pitch set up by the character pitch setup means.

According to this label printing apparatus, an easy crypt-message can be printed on the tape, for enjoyment.

Additional objects and advantages of the present invention will be set forth in the description which follows, and in part will be obvious from the description, or may be learned by practice of the present invention.

The objects and advantages of the present invention may be realized and obtained by means of the instrumentalities and combinations particularly pointed out hereinafter.

BRIEF DESCRIPTION OF DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 9 is a table listing, in correspondence, configurations of affix objects of labels and operational expressions of lengths of print regions on the tape, to be stored in a ROM;

FIG. 10 is a set of explanatory illustrations of measuring dimensions of objects to be input in accordance with configurations of the objects for the labels to be affixed thereon;

FIG. 11 is a flowchart showing a label creation process;

FIG. 18 is an explanatory illustration in which FIG. 17 is enlarged;

FIG. 23 is a character order conversion table between an input string of characters and an output string of characters, to be stored in a ROM;

FIG. 24 is an explanatory illustration for conversion of character orders between the input string of characters and the output string of characters;

BEST MODE OF CARRYING OUT THE INVENTION

There will be described embodiments of the present invention with reference to the drawings.

Figure 1:
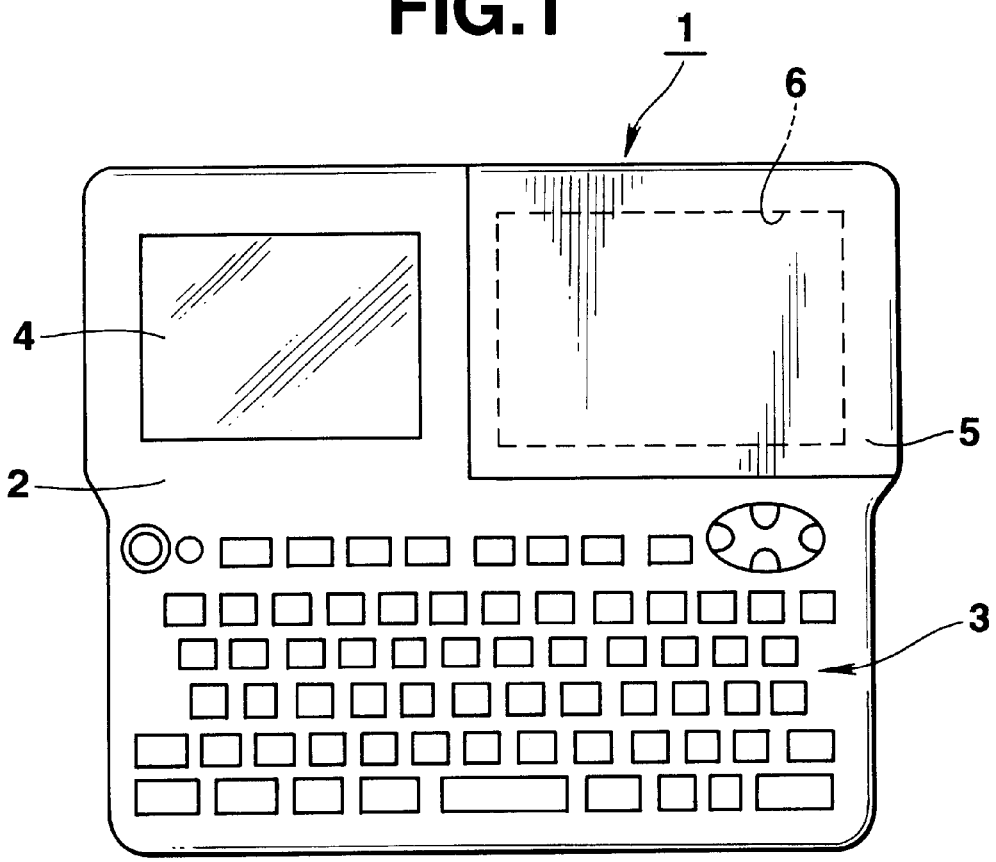
FIG. 1 is a plan view of a label printing apparatus according to the present invention.
Figure 2:
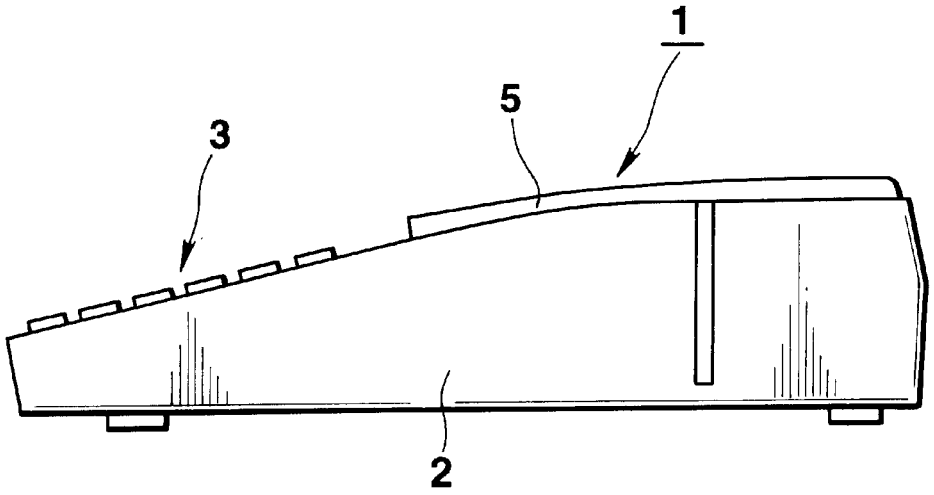
FIG. 2 is a side view of the label printing apparatus according to the present invention.

FIG. 1 is a plan view of a label printing apparatus, and FIG. 2, a side view. The label printing apparatus 1 shown in FIGS. 1 and 2 has, on an upside of an apparatus body 2, a key input device 3, a display device 4 and an open-close cover 5.

The key input device 3 has character keys for inputting data of a string of characters or symbols to be printed, a print key for instructing a print start, a cursor key for operations to move a cursor on a display screen of the display device 4, and other various necessary control keys such as for an editing process of an input character string, various setup processes and print processes.

The display device 4 is a liquid crystal display device, and displays input data as well as contents of processes.

Underside the open-close cover 5 is formed a cassette accommodation portion 6 in which a tape cassette with a printing tape installed therein is accommodated.

Figure 3:
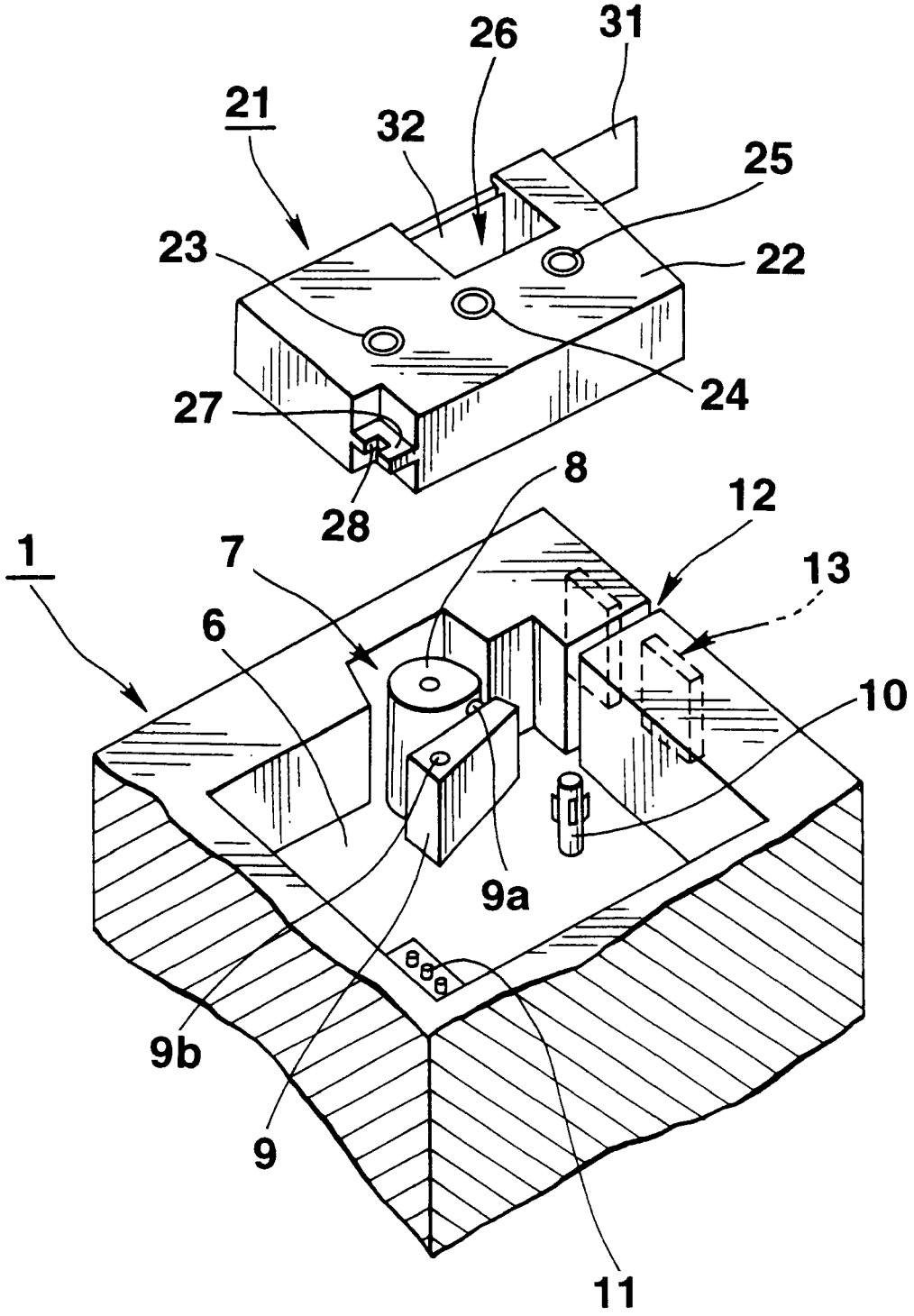
FIG. 3 is a perspective view of an inside of a cassette accommodation portion of the label printing apparatus, and an appearance of a tape cassette to be furnished to the cassette accommodation portion.

FIG. 3 shows, in perspective view, an inside of the cassette accommodation portion 6 of the label printing apparatus 1, and an appearance of the tape cassette 21 to be furnished to the cassette accommodation portion 6, as it has installed therein the printing tape 31 (hereafter simply called "tape") and an ink ribbon 32.

Figure 4:
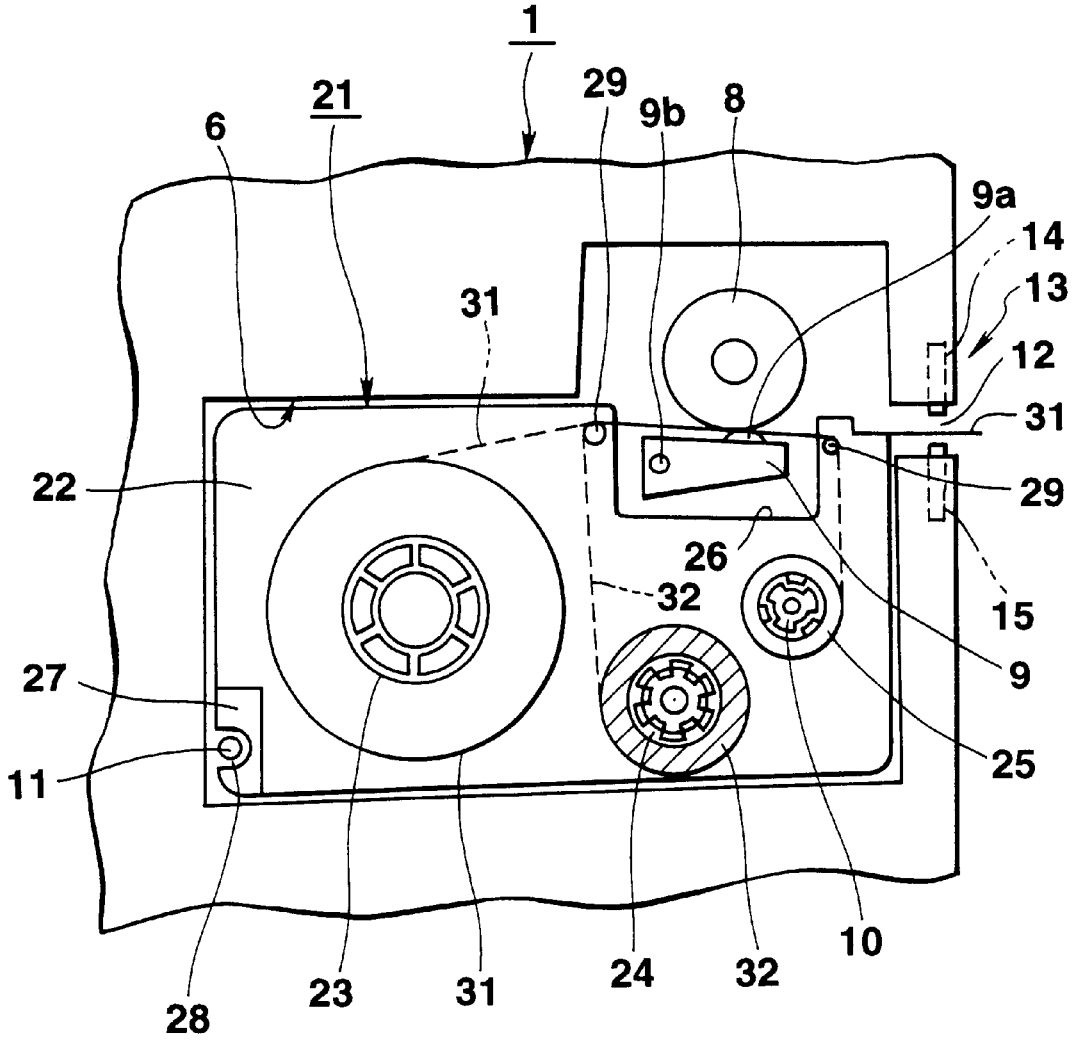
FIG. 4 is a plan view of a state in which the tape cassette is furnished to the cassette accommodation portion of the label printing apparatus.

FIG. 4 shows, in plan, a state in which the tape cassette 21 is furnished to the cassette accommodation portion 6 of the label printing apparatus 1.

In the cassette accommodation portion 6 of the label printing apparatus 1 is provided a printer portion 7 which includes a tape printing mechanism for performing a printing process to the tape 31, a tape carrying mechanism for carrying the tape 31 to be fed to the printing mechanism, a tape cutting mechanism for cutting a printed part of at an end of the tape 31, and the like.

Namely, in FIGS. 3 and 4, the cassette accommodation portion 6 has a platen roller 8, a thermal head 9, and an ink ribbon winding shaft 10 provided therein.

The platen roller 8 is driven by a drive mechanism (not shown), when printing, to carry the tape 31.

The thermal head 9 has a plurality of heat generating elements 9*a* arranged in an array in correspondence to a width direction of the tape 31, and the plurality of heat generating elements 9*a* are selectively driven to generate heat for the tape 31 to be printed in dependence on print data.

The thermal head 9 is rotated about a support shaft 9*b* by a head moving mechanism (not shown), having an interlocked relationship with an open-close action of the open-close cover 5, so that it is brought into pressure contact on the platen roller 8, as the open-close cover 5 is closed, such as when printing, and is spaced off from the platen roller 8, as the open-close cover 5 is opened, such as when replacing the tape cassette 21.

The ink ribbon winding shaft 10 winds up the ink ribbon 32, as it is used for printing.

Further, the cassette accommodation portion 6 is provided with a tape sensor 11 for detecting a width of the tape 31 installed in the tape cassette 21. The tape sensor 11 is constituted with a plurality of micro switches.

The tape cassette 21 has an identification part 27 corresponding to the width of the tape 31 installed therein, which causes the plurality of micro switches to be on-off operated in a diversity of combinations. With information output from the plurality of micro switches, a detection is effected of a width size of the tape 31 installed in the tape cassette 21.

Further, as shown in FIGS. 3 and 4, the tape cassette 21 to be furnished in the label printing apparatus 1 has, inside a cassette case 22, a tape hold reel 23 on which the tape 31 is wound, a ribbon supply reel 24 on which the ink ribbon 32 is wound before use, and a ribbon take-up reel 25 for winding the ink ribbon 32, as it is used.

At a side of the tape cassette 21, the cassette case 22 is cut in part to form a recess 26. At the part of recess 26, the tape 31 and the ink ribbon 32 are pulled out from inside the cassette case 22 and exposed.

As the tape 31, a plurality of kinds different in width are available for the label printing apparatus 1, and as the tape cassette 21 there are provided a plurality of kinds for installation of tapes 31 different in width.

Incidentally, the tape 31 to be installed in the tape cassette 21 comprises a tape body having a print side for a printing to be effected thereon, an adhesive agent coated on a reverse side to the print side of the tape body, and a base paper (exfoliation sheet) exfoliatively adhering to the reverse side of the tape body coated with the adhesive agent. Further, the ink ribbon 32 has an identical width to the tape 31, and its ribbon tape is coated with black ink.

Further, in FIGS. 3 and 4, designated by 27 is the tape identification part, which is shaped in a form corresponding to a kind of printing tape 31 installed inside, for on-off operations of plural switches of the tape sensor 11 to be effected by presence or absence of a cut-out 28. Assuming three switches to constitute the tape sensor 11, they can give 3-bit information for identification of 8 kinds of tapes in dependence on whether or not a respective switch of the tape identification part 27 is provided with the cut-out 28.

In FIG. 4, designated by 29 are guide members for guiding travels of the tape 31 and the ink ribbon 32 in the cassette case 22.

As shown in FIG. 4, when the tape cassette 21 is furnished in the tape cassette accommodation portion 6 of the label printing apparatus 1, the thermal head 9 is inserted to be disposed in the recess 26 of the tape cassette 21, and the ink ribbon winding shaft 10 is fitted in a reel hole of the ribbon take-up reel 25. At the recess 26 of the tape cassette 21 there are exposed the tape 31 and the ink ribbon 32 in an overlapping manner, as they are pulled out from the cassette case 22, to be interposed between the thermal head 9 and the platen roller 8.

The thermal head 9 is responsive to input print information from the key input device 3, for generating heat to thermally transfer ink of the ink ribbon 32 to the tape 31. As the thermal head 9 prints one line of characters or symbols, the platen roller 8 is driven to rotate so that the tape 31 and the ink ribbon 32 are fed to be carried by a predetermined distance from the tape cassette 21. The above printing action is repeated to effect a printing of a whole input character string. As used for the thermal transfer, the ink ribbon 32 is wound on the ribbon take-up reel 25 which is driven for rotation by the ribbon winding shaft 10.

As the printing is complete, the tape 31 is discharged by the platen roller 8, through a tape discharge outlet 12, outside the apparatus. Near the tape discharge outlet 12 is provided a cutter 13, by which a printed part at the end of the tape 31 is cut.

Figure 5:
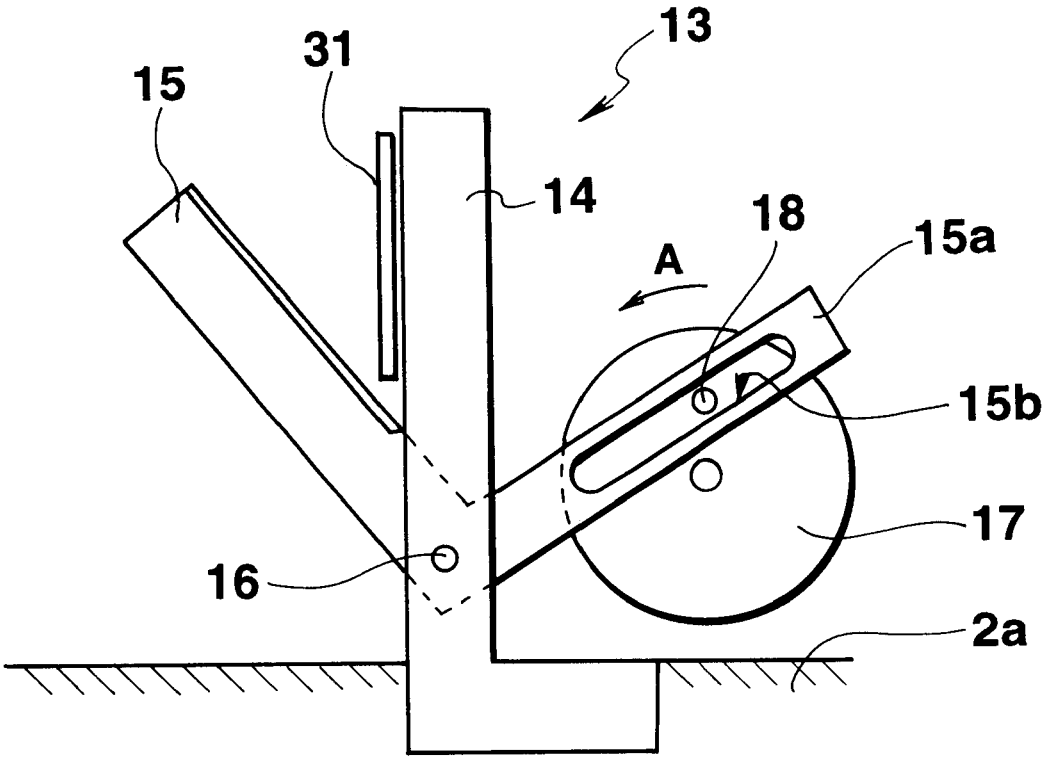
FIG. 5 is a front view of a cutter mechanism.

FIG. 5 shows a mechanism of the cutter 13. Designated by 14 is a stationary blade provided by fixing to a body frame 2*a* of the apparatus, 15 is a mobile blade rotatable about a shaft 16 relative to the stationary blade 14, and 17 is a rotary plate to be driven for rotation by a DC motor (not shown). The rotary plate 17 is provided with a pin 18, which is engaged with an elongate hole 15*b* of an arm 15*a* integrally provided to the mobile blade 15. As the rotary plate 17 rotates by one revolution from an initial position (shown in FIG. 5) in an arrow direction A, the mobile blade 15 moves relative to the stationary blade 14, cutting the tape 31 before opening apart from the stationary blade 14 to return to the initial position.

Incidentally, the thermal head 9 has 192 heat generating elements 9a arrayed on a line at a pitch of 8 dots/mm. Therefore, the thermal head 9 allows for a one-line printing to be effected with a 24-mm width at the maximum, whereas a tape carrying is set up for the printing tape 31 to have, in its width direction, a dot print formed thereon with a solution of 8 dots/mm, and in a longitudinal direction of the printing tape 31 also, a printing executed with an identical solution.

Figure 6A:
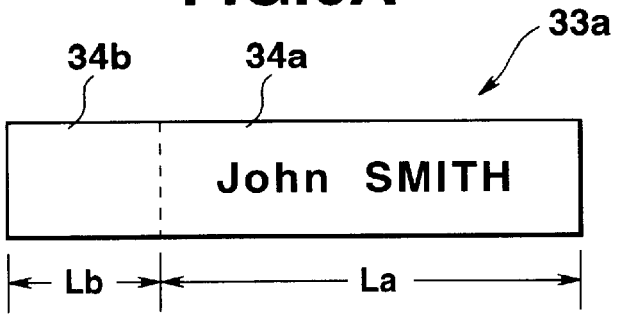
FIGS. 6A and 6B are illustrations showing labels created by cutting with a cutter, after a printing on a tape by the label printing apparatus.
Figure 6B:
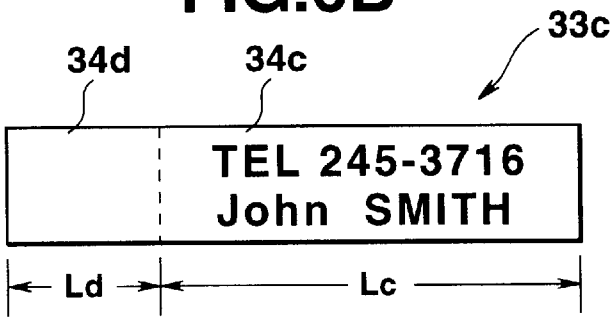
Figure 7A:
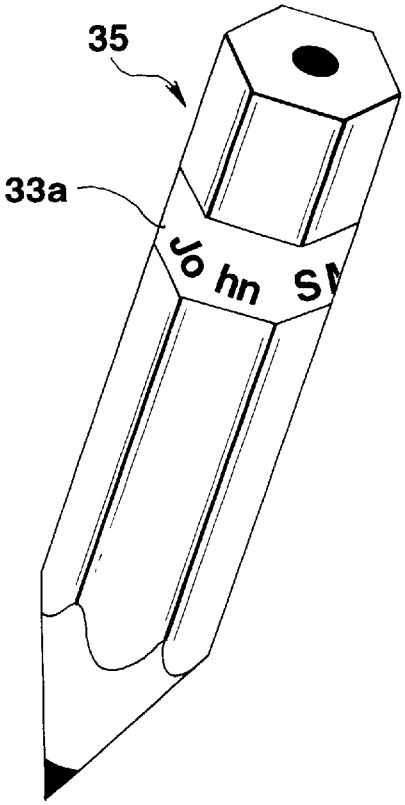
FIGS. 7A and 7B are illustrations showing states of use in which the labels of FIGS. 6A and 6B are wound and affixed on objects.
Figure 7B:
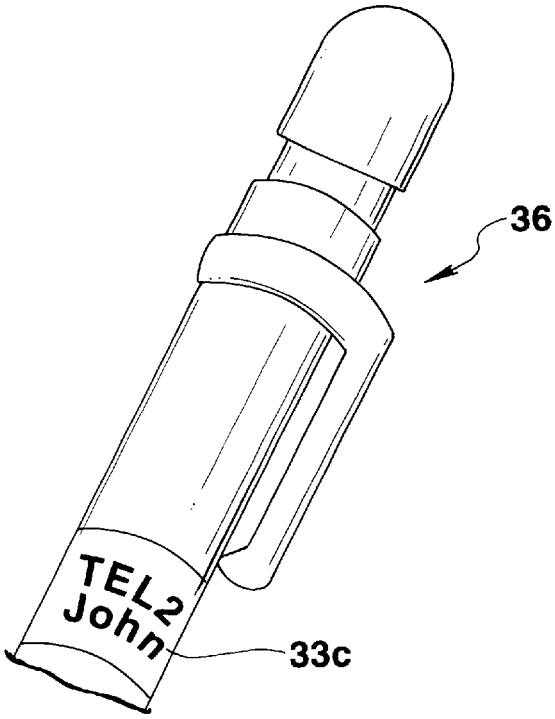

FIGS. 6A and 6B are illustrations respectively showing labels created by cutting with the cutter 13, after a printing on the tape 31 by the label printing apparatus 1, and FIGS. 7A and 7B, illustrations showing states of use in which those labels are wound and affixed on objects.

FIG. 6A illustrates a label 33*a* created by cutting the tape 31, with a length as a sum of a print region 34*a* having a length La corresponding to one round along an outer circumference of a stem of a pencil and an overlap allowance region 34*b* having a length Lb.

FIG. 7A illustrates the label 33*a*, as it is wound on a pencil 35 of a hexagonal form.

The label 33*a* has characters of "John SMITH" printed with character sizes suitable in the print region 34*a*. The label 33*a* is wound on the pencil 35, with the print region 34*a* overlapped at a right end part thereof on the overlap allowance region 34*b*.

The overlap allowance region 34*b* is not always needed, as its provision is for the label end to be hard to peel.

FIG. 6B illustrates a label 33*c* created by cutting the tape 31, with a length as a sum of a print region 34*c* having a length Lc corresponding to a length of an outer circumference at a stem of a mechanical pencil 36 and an overlap allowance region 33*d* having a length Ld.

FIG. 7B illustrates the label 33*c* wound on the mechanical pencil 36 of a circular cylinder.

The label 33*c* has characters of "TEL 245-3716, John SMITH" printed in two lines, with character sizes suitable in the print region 33*d*.

Figure 8:
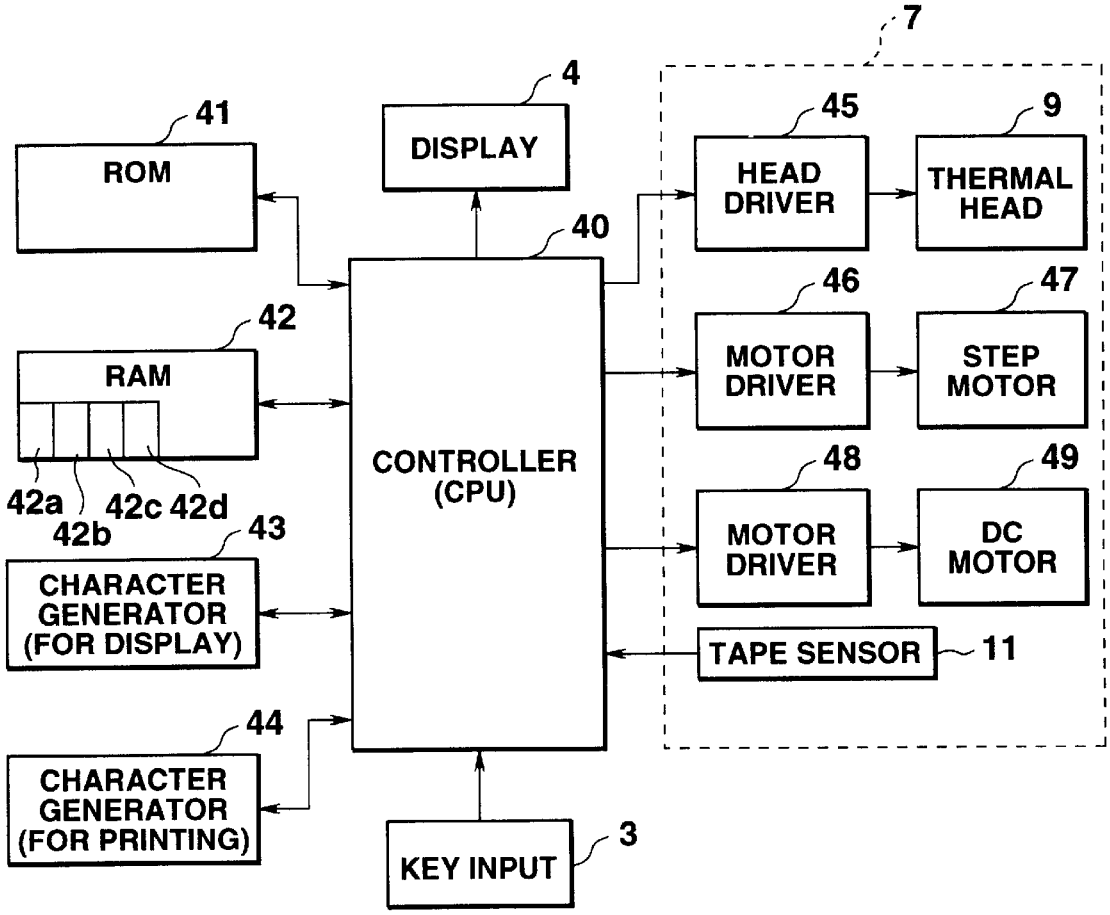
FIG. 8 is a block diagram of an electronic circuit of the label printing apparatus.

Next, FIG. 8 shows, in block diagram, an electronic circuit of the label printing apparatus 1.

The printing apparatus 1 comprises a controller 40, the key input device 3, a ROM 41, a RAM 42, a character generator 43 for display, a character generator 44 for printing, the display device 4, and a printer device 7.

The controller 40 is constituted with a CPU (central processing unit) connected to the key input device 3, the ROM 41, the RAM 42, the character generator 43 for display, the character generator 44 for printing, the display device 4, a head driver 45 for driving the thermal head 9, a motor driver 46 for driving a step motor 47 as a drive for the platen roller 8 and the ink ribbon winding shaft 10, a motor driver 48 for driving a DC motor 49 as a drive for the cutter 13, and the tape sensor 11.

The controller 40 responds to a control signal input from the key input device 3, for executing programs stored in the ROM 41.

The ROM 41 has stored therein, in advance, programs of various processes to be executed by the controller 40, including a label creation process and a printing process, data on a print format such as a number of lines of characters or symbols printable in accordance with a tape width, a size of characters or symbols, a printing interval, and a line interval, as well as various data necessary for creation of labels according to the present invention.

The RAM 42 is employed as a work area for process programs to be executed by the controller 40. Further, the RAM 42 has storage regions secured therein for various data. Namely, designated by 42*a* is an input buffer for storing data on a respective character code of data on a string of characters or symbols to be printed, as they are input in response to operations of character/symbol input keys at the key input device 3, 42*b* is a display buffer for storing bit map data corresponding to a string of characters or symbols to be displayed on the display device 4, 42*c* is a print buffer for storing bit map data (print data) corresponding to data on a string of characters or symbols to be printed at the printer device 7, and 42*d* is a register group for temporary storage of data to be set for the printing as well as of various required data when processing the printing.

The character generator 43 for display has stored therein pattern data of characters or symbols to be displayed on the display device 4.

The character generator 44 for printing has stored therein pattern data of characters or symbols of a plurality of sizes to be printed at the printer device 7.

The printer device 7 comprises the thermal head 9, the step motor 47, the thermal head driver 45, the DC motor 49, the motor driver 48, the platen roller 8, the ink ribbon winding shaft 10, the tape sensor 11, etc., and is adapted for a thermal transfer system to thereby print characters or symbols in a longitudinal direction of the tape 20.

FIG. 9 shows a table of operational expressions for calculating lengths of print regions of tapes in accordance with configurations of label-affix objects (which are lengths of outer circumferences of the objects and also lengths of labels to be wound around the objects), as data to be stored in the ROM 41.for use in creation of labels according to the present invention. Configuration Nos. 1, 2, 3, 4 and 5 of the objects correspond to winding parts of the objects for the labels to be wound to be affixed thereon, as a regular triangle, a square, a regular hexagon, a circle, and an oblate form in cross section, respectively.

The label printing apparatus according to the present invention is operative simply by measuring and inputting a size in part associated with a configuration of an object, for automatically calculating a total length of an outer circumference at a winding part of the object to set up a length of a label, without the need of measuring the total length of the outer circumference at the winding part of the object to set up a length of a label.

FIG. 10 describes, in a corresponding manner, measuring dimensions of objects to be input by the user in accordance with configurations of the objects for the labels to be affixed thereon. As illustrated by the Figure, if the object is a regular triangle in cross-sectional configuration at the label winding part, a height dimension H1 of the regular triangle is what is to be measured, and this is input. It is a length H2 of a lateral in the case of a regular quadrangle, a distance H3 of parallel two laterals in the case of a regular hexagon, a diameter H4 in the case of a circle, and a width H5 and a thickness H6 in the case of an oblate form. FIG. 10 only shows examples of measuring dimensions of objects. The measuring dimensions can be freely changed. For example, if the object is a regular triangle, it is possible to measure a length of each side.

When the configuration of an object (FIG. 9) is defined, the size of a specified measuring dimension shown in FIG. 10 can be input, allowing for an operational expression in the table of FIG. 9 to be based on to determine a length Z of print region of the label (the length of an outer circumference of the object, the length of the label).

Next, on the basis of a flowchart in FIG. 11, there will be described a creation process of a label to be wound by one round on an outer circumference of such an object as shown in FIGS. 6A and 6B, having a wound part on the outer circumference of the object, as a print region in which an input character string is printed.

A winding label creation key of the key input device 3 is now operated, having its label creation mode set up, causing a label creation process of FIG. 11 to start.

Figure 12:
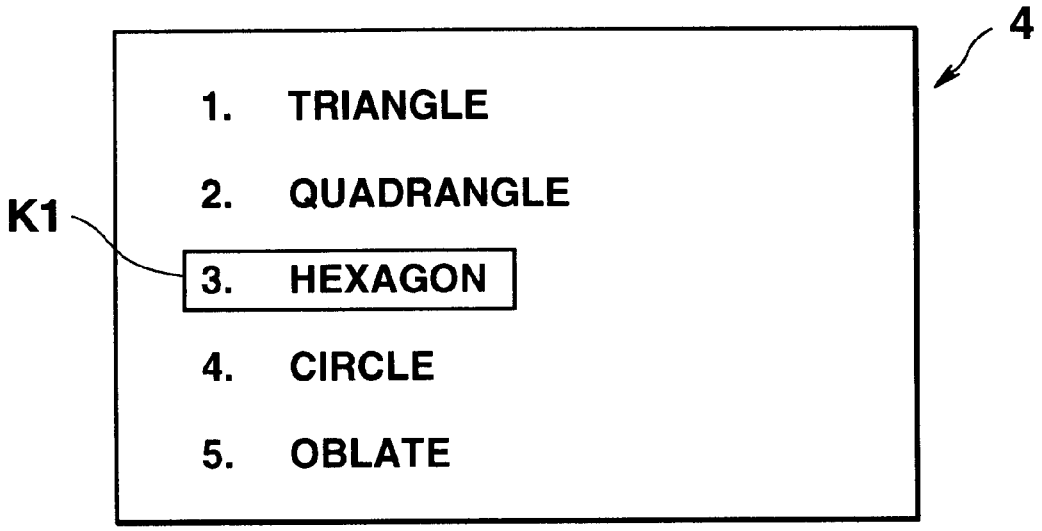
FIG. 12 is first explanatory illustration of a setup screen displayed on a display section in the label creation process.

First, a preset initial process (step Si) is followed by a screen displayed on the display section (step S2), for selecting a configuration of an object for a winding label to be wound thereon. FIG. 12 illustrates the selection screen. In FIG. 12, there are displayed characters representing configurations of object, together with numbers. The user moves a cursor K1 by a key operation, getting a match with a configuration presentation of a desired object, and operates an execution key to thereby select a configuration for the object. When a configuration of object is selected (step S3), the selected data is stored in the register 42*d* of the RAM 42 (step S4).

Figure 13:
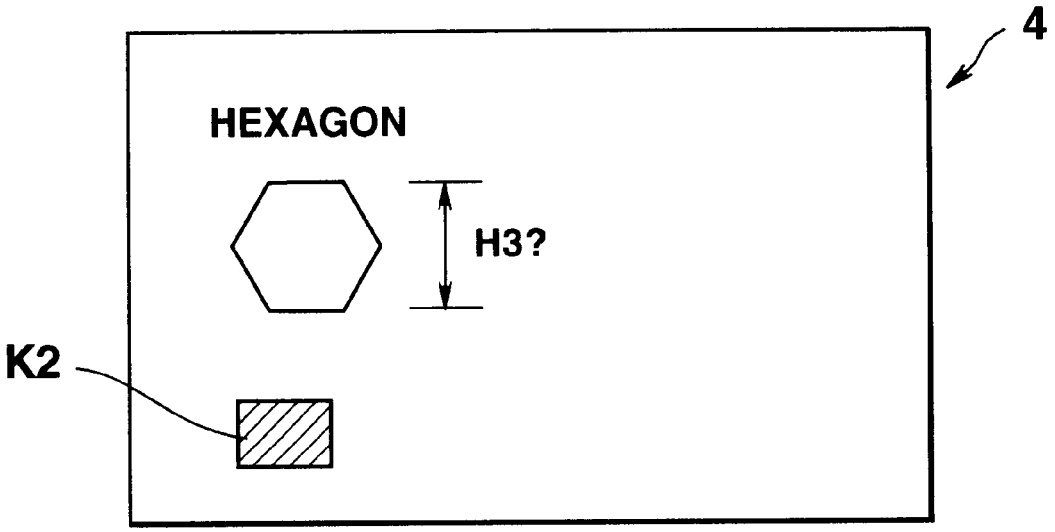
FIG. 13 is second explanatory illustration of a setup screen displayed on a display section in the label creation process.

In order to define a length of an outer circumference of an object of the selected configuration, the display device 4 displays thereon a screen, together with an icon, requesting an input of a particular dimension relating to the configuration of the object (step S5). FIG. 13 illustrates the screen. As a hexagon is selected to be the configuration of the object, there is displayed a screen requesting a dimension H3 between its parallel two laterals. The user employs numeric keys of the key input device 3 to input, at a location of a cursor designated by K2, a size of the specified dimension, as it is measured from the object. The specified dimension to be measured differs in dependence on a configuration selected at the step S4. The details are as described in explanation of FIG. 10.

When measurement data is input (step S6), the data is stored in the register 42d of the RAM 42 (step S7).

Next, the display device 4 displays thereon a setup screen for an overlap allowance (step S8). If here is made a setup for the overlap allowance, there is set a flag F to be provided in the register 42*d* of the RAM 42 (steps S9 and S10), but unless the setup is made, the flag F is reset (steps S9 and S11).

Then, the display device 4 displays thereon a screen requesting an input of data to be printed on a label (step S12), and if a string of characters or symbols to be printed is input (step S13), its input data are stored in the input buffer 42*a* (step S14).

Like this, inputs of necessary matters are now finished, waiting for an instruction of print to be given by operation of a print key in the key input device 3 (step S15).

When the instruction of print is given by operation of the print key, the data set up on a configuration of an object at the step S4 is based on to read in correspondence to the configuration an operational expression shown in the table of FIG. 9 and stored in the ROM 41, and to substitute in the operational expression numeral data set up at the step S7 to have, in respect of a tape (label) to be wound on an outer circumference of the object, its length (as a length of the outer circumference of the object, and also a length of a print region) Z calculated (step S16). In the example of FIG. 6A, the length La of the print region 34*a* is $\pi \times H4$, as it is given from the operational expression, and in FIG. 6B, the length Le of the print region 34*c* is $H3/\sqrt{3}$ as from the operational expression. The determined length Z is stored in the register 42*d* of the RAM 42, assuming a print line number (the number of print dots in a longitudinal direction of the tape) to be N.

Then, in accordance with the determined length Z, a width of the tape 31 to be detected by the tape sensor 11, and the number of characters or symbols of the input character string, there is made a reference to the above-described format data in the ROM 41, to have formats such as of a character size, a character spacing and a line spacing determined to be suitable for the determined length Z and set in the register 42*d* of the RAM 42 (step S17). In this case, the character spacing is adjusted for respective characters of the string of characters or symbols to be evenly allotted to the length determined at the step S16. In other words, from the length Z determined at the step S16, a sum of character lengths of respective character parts of the string of characters or symbols (width size of character×number of characters) is subtracted to determine a length of spacing, which is divided by the number of character intervals of the string of characters or symbols to determine the character spacing. By setting this character spacing between characters, the respective characters of the string of characters or symbols are evenly allotted in the determined length Z. Incidentally, in a case adequate margins are provided at front and rear ends of the string of characters or symbols, from the length z determined at the step S16, the sum of print lengths of respective character parts of the string of characters or symbols and lengths of the two margins are subtracted to determine a length of spacing, which is divided by the number of character intervals of the string of characters or symbols to determine the character spacing.

After the setting of format, with respect to characters of the input character string, their pattern data corresponding to a set character size are read from the character generator 44 for printing, and developed on the print buffer 42*c*, providing a set character spacing (step S18).

For the printing process, a decision is made of the setting of an overlap allowance at the step S9 (step S19).

The process is different, by presence or absence of an overlap allowance setting.

For a structure of the label printing apparatus which has as shown in FIG. 4 a distance between the cutter 13 and the thermal head 9, the label printing apparatus is adapted to carry the tape 31 merely downstream, and unable to return upstream, and the printed tape 31 has at its end, in correspondence between the cutter 13 and the thermal head 9, a part left as an unprintable blank portion. The labels 33*a* and 33*c* of FIGS. 6A and 6B are provided with overlap allowances 33*b* and 33*d* at their ends, for which overlap allowances the blank portion is made use of, as it develops at the tape end.

Therefore, if the setting of overlap allowance is absent, then a start of a printing is followed by an interruption of the printing for a process to cut the blank portion at the tape end, whereas such a process is not provided when an overlap allowance is set.

There will be described a printing process. When the flag F is set or an overlap allowance setting is made, pattern data of an input character string as developed on the print buffer 42*d* are read by line after line to be transferred to the thermal head 9, where they are printed on the tape 31 by driving the heat generating elements 9*a*. With one line printing, the step motor 47 is driven by one step, rotating the platen roller 8, carrying the tape 31 by a width of one line (step S20). A print line number is counted by a counter provided at the register 42*d* of the RAM 42. In this case, the print line number corresponds to a drive step number of the step motor 47 driving the platen roller 8 which carries the tape 31, and the drive step umber of the step motor 47 is counted to thereby control the print line number and a feed of the tape 31.

A count value of printed print lines is compared with the print line number N initially set in correspondence to the length Z of print region, and unless the count value has reached N (step S21), the printing is sequentially repeated for a subsequent one line (step S20). When the print is over for all print lines, the tape 31 is discharged, and the cutter 13 is operated to cut the tape 31 (steps S21, S22 and S23). The discharge feed of the tape 31 after print is a fraction corresponding to a distance between the cutter 13 and the thermal head 9, and more specifically, it is a fraction additionally including a more or less blank to be set at a rear end of the string of characters or symbols. The discharge feed of the tape 31 is controlled by counting the step number of the step motor 47 driving the platen roller 8. When the tape 31 is carried to a position of the cutter 13, the driving of the step motor 47 is stopped, and the DC motor 49 is driven to execute a cutting process. The above operation is similarly performed in the cutting processes described later.

A label is thereby created, which has a length of print region corresponding to the length of an outer circumference of such an object as shown in FIGS. 6A and 6B and is provided with an overlap allowance.

If the flag F is reset or the overlap allowance setting is absent, a blank part at the leading end of the tape 31 is cut to be removed just after the start of printing.

Pattern data of an input character string as developed on the print buffer 42*c* are read by line after line to be transferred to the thermal head 9, where they are printed on the tape 31 by driving the heat generating elements 9*a*. The step motor 47 is driven by one step, rotating the platen roller 8, carrying the tape 31 by a width of one line (step S24). A leading part of a printed character string advances up to front of the cutter 13, and with a decision that it has reached an interrupt position, the driving of the thermal head 9 and the platen roller 9 is stopped to interrupt the printing, and the DC motor 49 is driven for operating the cutter 13 to cut a leading end part of the tape 31 (steps S25 and S26). Thereafter, the printing restarts, and is performed up to a final print line of print data (steps S27 and S28). Upon a completion of the printing, the tape 31 is discharged, driving the DC motor 49, thereby operating the cutter 13 to cut the tape 31 (steps S28, S22 and S23).

A label is thereby created, without overlap allowance.

As described hitherto, according to the embodiment, there is be provided a label printing apparatus adapted, by inputting a configuration of an object of winding/affix and a numeral value on a configuration-depending characteristic defining the configuration, to automatically determine a length of a label, and print characters or symbols, having them adequately arranged within the length. The label has a preferable length to be wound/affixed around the object.

Next, there will be described another embodiment of the present invention. In the previous embodiment, characters or symbols are printed in a part to be wound/affixed on an object. In the present embodiment, however, no characters or symbols are printed in a part to be wound/affixed, but characters or symbols are printed in a region connected to the part to be wound/affixed. A resultant label is preferable for affix such as to a distribution code, for example.

Figure 14:
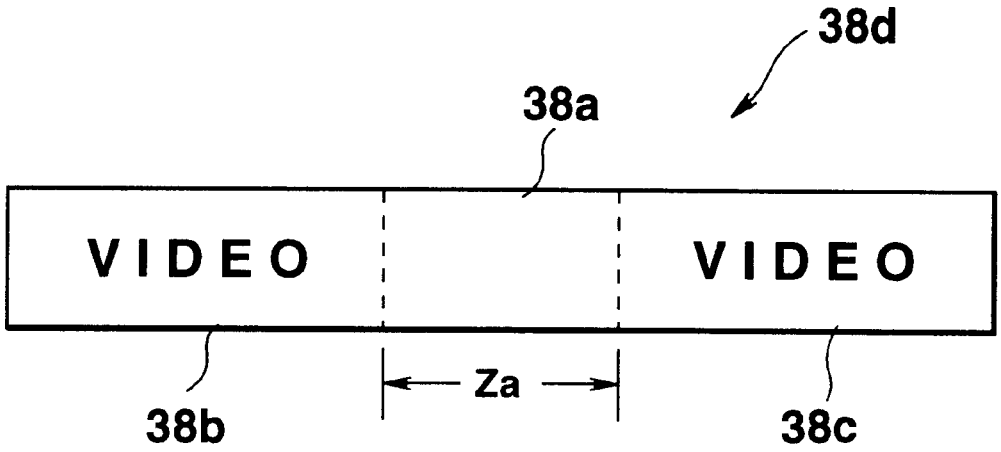
FIG. 14 is an illustration showing an exemplary print on a label according to another embodiment of the present invention.
Figure 15:
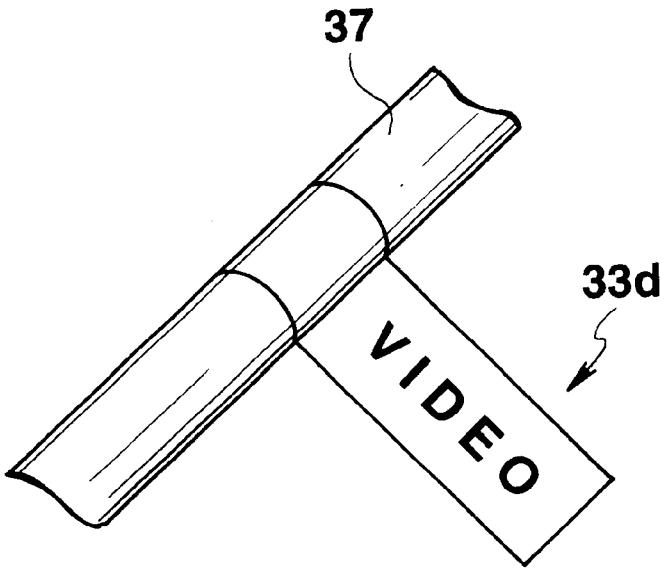
FIG. 15 is an explanatory illustration of an exemplary use of the label of FIG. 14.

FIG. 14 is an illustration showing an exemplary print on a label according to the other embodiment. FIG. 15 is an explanatory illustration of an exemplary use of the label of FIG. 14.

As shown in FIG. 14, a winding region 38*a* of a length Za is provided at a central part of a label 33*d*, and print regions 38*b* and 38*c* of an identical length are provided at both sides thereof. FIG. 15 illustrates an exemplary use of the label 33*d*, in which the winding region 38*a* is wound and affixed on a distribution cable 37 of a video apparatus, and the print regions 38*b* and 38*c* at its both sides are overlapped on and affixed to each other.

Figure 16:
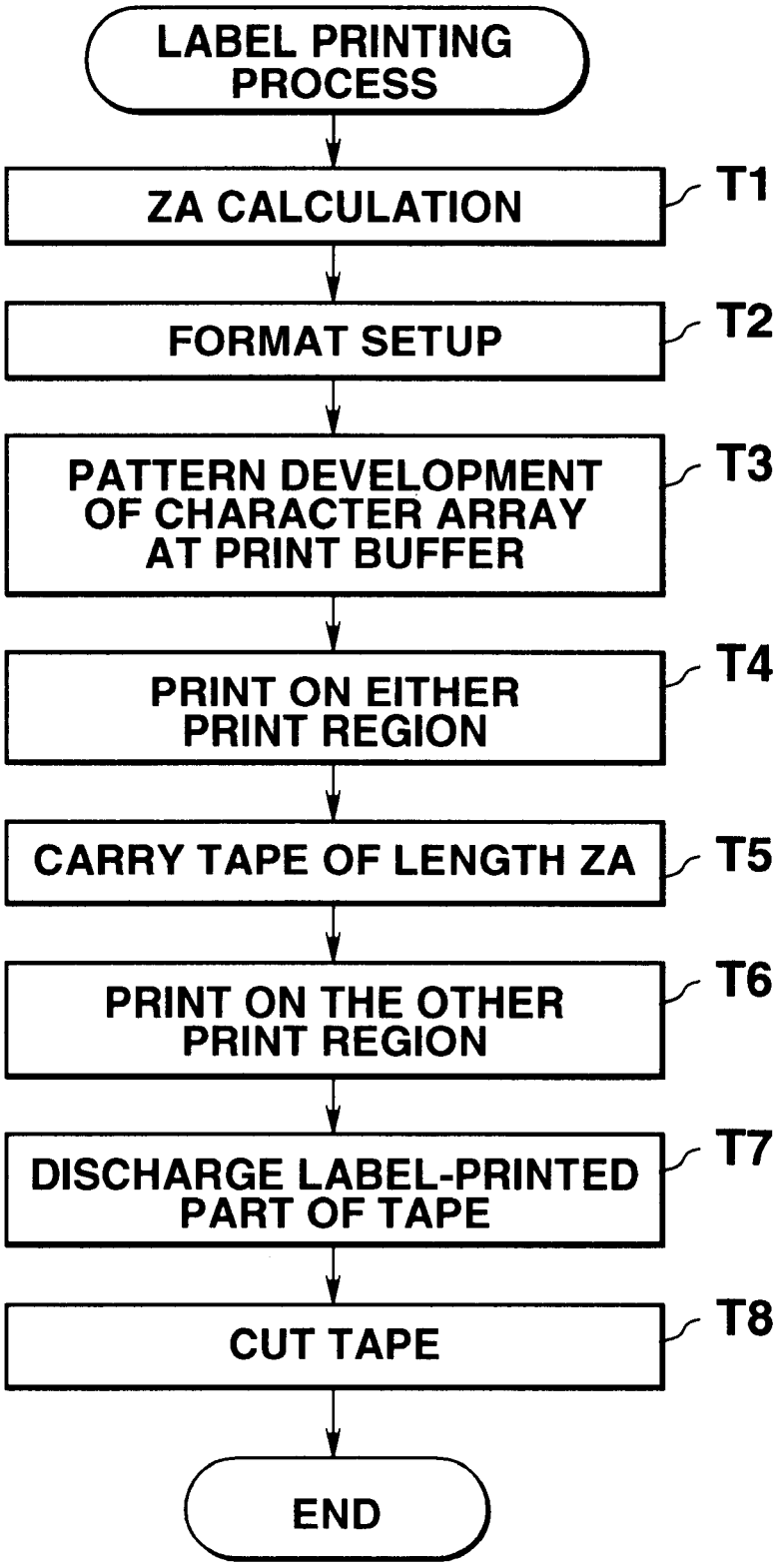
FIG. 16 is a flowchart showing another label creation process.

FIG. 16 is a flowchart of a print process for the label of FIG. 14.

Like the steps S2 to S27 and S12 to S14 for label creation process of FIG. 11, a selection of a configuration of an affix object, an input of a numeral value associated with the configuration, and an input of a string of characters or symbols to be printed are performed, and a print key is operated, then on the bases of the set configuration of the object and the numeral associated with the configuration there is determined the length Za of the winding region 38*a* by using a corresponding operational expression of FIG. 9 (step T1). A format is set up such as for a character size and a character spacing of the input character string to be printed on the print regions 38*b* and 38*c* (step T2). The character size is automatically determined, by a detection of a width of a furnished tape, to an optimum character size suitable in the tape width. Further, the character spacing also is automatically set to an adequate value, unless particularly specified.

Pattern data of a set size corresponding to the input character string stored in the input buffer 42*a* are read from the character generator 44 and developed on the print buffer 42*c* (step T3).

Then, with the developed pattern data transferred one line after one line to the thermal head 9, the thermal head 9 is driven, concurrently carrying the tape, printing an input character string of "VIDEO" on the print region 38*b* (step T4). After the printing to the print region 38*b*, the tape 31 is carried by a fraction corresponding to the calculated length Za of the winding region 38*a*. As the tape feed per one step of the step motor 47 driving the platen roller 8 is preset, a decision is made of a tape feed of the length Za by counting a drive step number of the step motor 47 (step T5).

After the step T5 whose process secures the winding region 38*a*, there is performed a printing on the print region 38*c* (step T6). To the print region 38*c*, the same character string as the print region 38*b* is printed. Incidentally, they may have different character string printed thereon. In this case, for each of them, a corresponding different character string is to be keyed in.

When the printing of the print region 38*c* is over, the tape 31 is discharged outside the apparatus (step T7), and the tape 31 is cut (step S8) before the end.

The created label 33*d* has a base sheet on a reverse side of its tape body, which is exfoliated for exposure of an adhesive agent, and as shown in FIG. 15, the winding region 38*a* is wound and affixed on the cable 37 of the video apparatus, and the print regions 38*b* and 38*c* are brought into abutment at their reverse sides and overlapped on each other.

In the embodiment of FIGS. 7A and 7B, a print region of a label is set in correspondence to a part to be wound on an outer circumference of an object. In such a label, in a case the object is of a small configuration and the length of its outer circumference is short either, the print region also has a small size so that the size of a printable character also has to be small, and further as it is affixed along an outside configuration of the object, a string of characters or symbols may be difficult to observe if the outside configuration is a curved surface.

However, in the present embodiment, as the part to be wound on an outer circumference of an object functions as a region to be affixed and print regions are set to be other than the winding part, the print regions can be relatively large in comparison with the winding region irrespective of the size of an object, and further as the print regions allowed to be flat irrespective of an outer circumferential configuration of the object, a printed character string is easy to observe. The print regions project off in a surrounding space, and in some case, the projecting label parts may constitute an obstacle in comparison with a label according to the embodiment of FIGS. 7A and 7B.

Therefore, in accordance with the use, a label of FIGS. 7A and 7B or of FIG. 15 is to be selectively applied.

Figure 17:
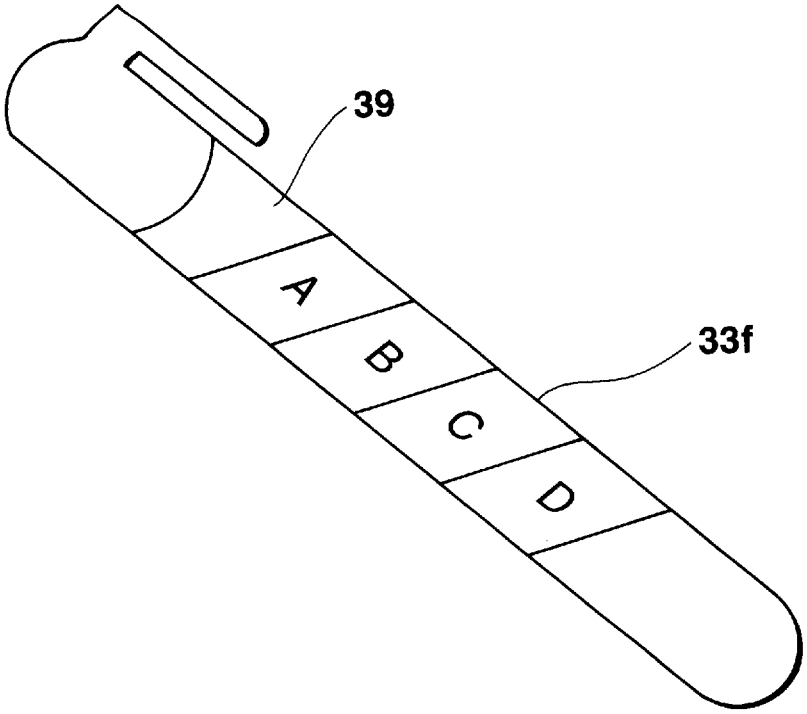
FIG. 17 is an illustration showing a label spirally wound and affixed on an object.

Next, FIG. 17 illustrates a label 33*f* spirally wound and affixed on an object (a ball point pencil 39 with a big stem).

Figure 18:
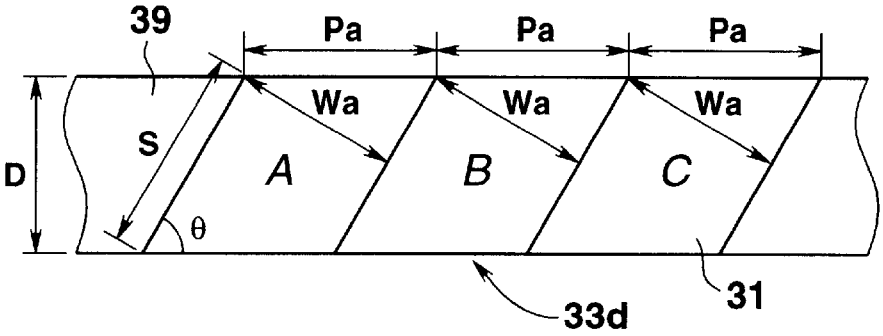

As shown in FIG. 18, letting D be a diameter of the object 39 of a circular cylindrical configuration, a tape 31 of a width Wa of which a wounding pitch is Pa is used, and the tape 31 (label 33f) has a winding angle θ relative to an axial direction of the object 39.

In the case of a label of FIGS. 7A and 7B or FIG. 15, it is wound by a round along an outer circumference of an object, and the winding angle θ is 90°. In the case of a spiral winding, however, θ becomes a smaller angle than 90°.

Further, as shown in FIG. 1, in this example, the tape 31 is helically wound on the object at a predetermined winding pitch so that, between winding cycles, neighboring tapes will not overlap on each other.

In the case of a label to be spirally wound on an object under such a condition, the winding angle θ is made as a variable angle in dependence on the diameter D of the object, the width Wa of the tape, and a winding pitch. Stated another way, the angle θ is determined in dependence on the diameter D of the object, the width Wa of the tape, and the winding pitch.

Figure 19:
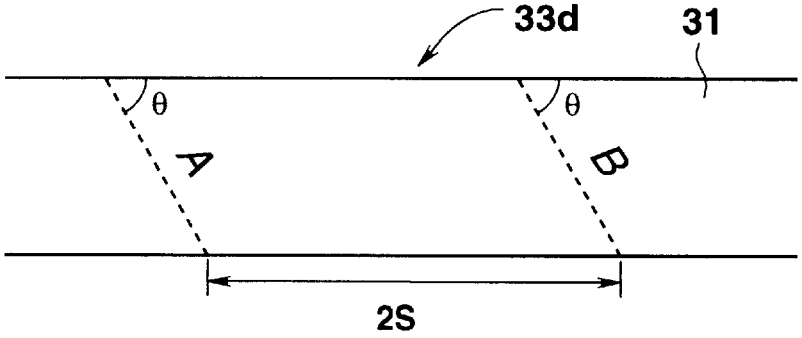
FIG. 19 is an explanatory illustration of a state in which the label of FIG. 17 is extended.

Further, as shown in FIG. 18, a string of characters or symbols printed on the tape 31 looks standing upright in a wound state on the object 39, and therefore, as shown in FIG. 19 in which the tape 31 is extended, characters or symbols have to be clockwise rotated at θ to be printed on the tape 31. Further, for arrangement of characters or symbols of the string of characters or symbols to be aligned in an axial direction of the object 39, letting S be a half circumferential length of the label 31 wound on the object 39, the characters or symbols of the string of characters or symbols need to be arrayed at a character pitch of 2S.

Figure 20:
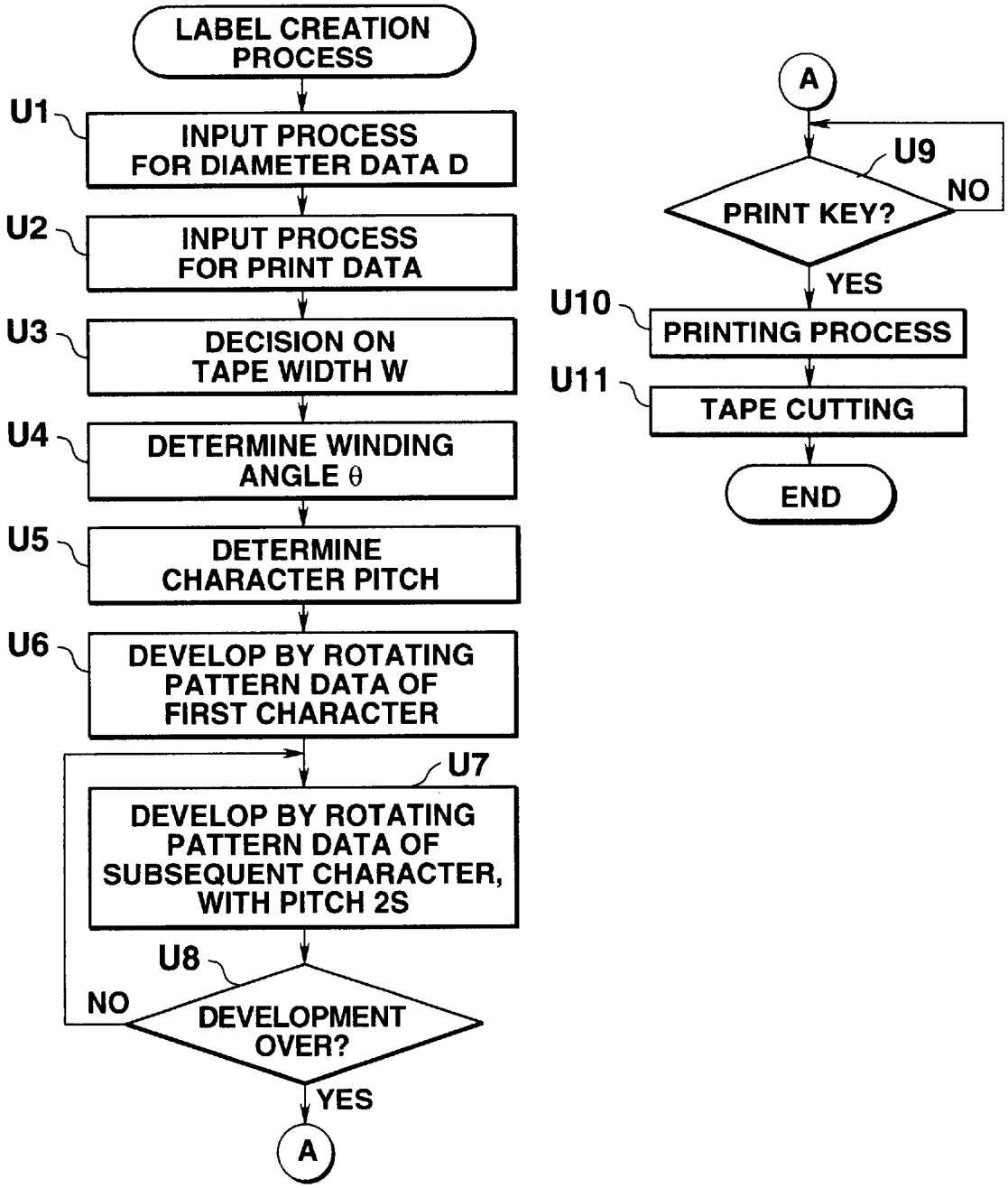
FIG. 20 is a flowchart showing a creation process of the label of FIG. 17.

FIG. 20 shows, in flowchart, a creation process of a label 33*f* to be wound an object 39 such as of FIG. 17.

For this process, the ROM 41 has necessary data stored therein.

Namely, as described, in the case of a label to be spirally wound on an object, its winding angle θ depends on a width of the tape, a diameter of the object of a circular cylindrical form, and a winding pitch. The tape 31 to be used in the label printing apparatus 1 has a preset width, which width can be discriminated by the tape sensor 11. Therefore, values of the winding angle θ depending on the width of the tape, the diameter of the object, and the winding pitch are listed in correspondence to widths of tapes and diameters of objects, and stored in advance as a table in the ROM 41. If the winding pitch is set as shown in FIG. 18, the ROM 41 stores the winding angle θ merely depending on the width of the tape and the diameter of the object.

Incidentally, if the winding pitch is set shorter that that shown in FIG. 18, neighboring tapes overlap on each other since the tape width exposing to the surface of the object becomes shorter. In this case, the characters or symbols must be printed so as not to be printed on the overlapped region. If the boundary of the overlapped region is indicated in the tape by a line, it is easy to spirally wound the label on the object. In the example of FIG. 18, there is no overlapped region. It is to be noted that the data of winding angle θ stored in the ROM 41 cannot be used for the case in which the tape is not wound with a constant pitch.

There will be described a creation process of a label to be spirally wound on the object with reference to FIG. 20.

A predetermined key for setting a creation mode of a spiral winding label is operated, whereby the program of FIG. 20 starts.

First, the user makes an input process of a diameter D (step U1). At this time, it is possible to input the winding pitch. For example, plural predetermined pitches are displayed on the display device 4 and the user selects one of them by using the key input device 3. Then, the user makes an input process of a string of characters or symbols (step U2).

Then, the controller 40 discriminates a width W of a furnished tape 31 on the basis of an output from the tape sensor 11 (step U3).

And, in dependence on the diameter D, the width W of the tape 31, and the winding pitch, the table in the ROM 41 is referenced to thereby determine a winding angle θ. A data on the determined angle θ is stored in the register 42*d* of the RAM 42 (step U4). In the case of FIG. 18, since the winding pitch is predetermined, the table in the ROM 41 which stores the winding angle θ corresponding to the diameter D and the width W of the tape 31 is referenced to.

Next, a character pitch of the string of characters or symbols is determined (step U5). Letting S be a half circumferential length of the label 31 wound on the object 39, the character pitch is represented by a winding length 2S for one round. And, 2S is determined by $(\pi \times D/2)/\cos(90° - \theta)$. A data on the determined character pitch is stored in the register 42*d* of the RAM 42.

Then, a pattern data corresponding to a first character of the input character string is read from the character generator 44 for printing, and developed on a work region of the RAM 42. And, for respective dots constituting the pattern data in developed state, an angle of 360°−θ is rotation-processed in a counter-clockwise direction and developed on the print buffer 42*c* (step U6). Likewise, pattern data of the next character is read from the character generator 44 for printing and developed on a work region of the RAM 42, and for respective dots constituting the pattern, an angle of 360°−θ is rotation-processed in a counter-clockwise direction and developed on the print buffer 42*c*. At this time, a character pitch of 2S is set relative to the character antecedent by one character (step U7). This development process is repeated to a final character of the string of characters or symbols. (steps U7 and U8).

Then, an instruction for print start is waited for, and with the instruction of print given, developed pattern data are transferred to the thermal head 9, where they are printed, and finally, the DC motor 49 is driven for operating the cutter 13 to cut the tape 31 (steps U9, U10 and U11).

A label created like this is adapted to present a string of characters or symbols printed to be arrayed, on an outer circumference of an object, in an axial direction thereof. As the position for the string of characters or symbols to be arrayed is in the axial direction on the outer circumference of the object, the string of characters or symbols is allowed to be presented over a relatively long distance, with a large character size and in a state easy to observe. Further, as the label can be wound by rounds on the object, it hardly peels from the object.

Next, there will be described an example in which a tape has its tape body made of a transparent resin material, and a label created by using the tape is wound in layers on a particular object, so that a string of characters or symbols printed on the tape and unclear in meaning can be recognized as a meaningful sentence.

Figure 21:
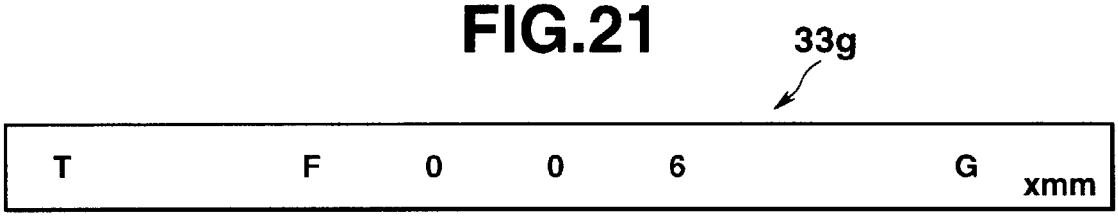
FIG. 21 is an illustration showing an exemplary print on a label according to another embodiment of the present invention.

FIG. 21 illustrates a label 33*g* which is created from a transparent tape and has printed thereon a string of characters or symbols "T FOO6 G" unclear in meaning, a so-called crypt-sentence. Further, at a right end of the label 33*g*, there is printed a numeric length value, X mm (where, X is a concrete numeric value).

Figure 22:
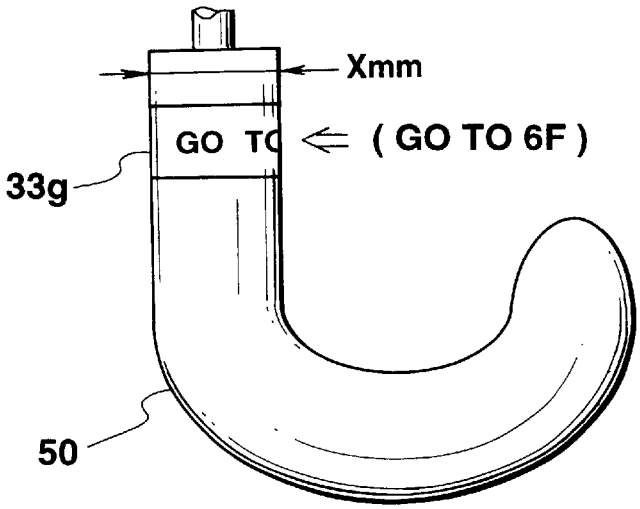
FIG. 22 is an explanatory illustration of an exemplary use of the label of FIG. 21.

FIG. 22 illustrates a case in which the label 33*g* is wound up on a grip 50 of an umbrella. The umbrella's grip 50 has a diameter of an X mm length, and the label 33*g* is wound on the grip 50, overlapping a plurality of times, whereby a meaningful character string "GO TO 6F" can be observed.

Next, there will be described a creation procedure of the label.

The print out put on the label 33*g* of FIG. 21 has a corresponding input character string, which is "GO TO 6F" like t he string of characters or symbols observed in FIG. 22.

When the user has input a desired meaningful sentence by using character input keys in the key input device 3, constituent characters of the input sentence are changed in order , and distances between the characters or symbols are determined based on a predetermined procedure for a printing on a tape. Further, the dimension value X mm is a diameter value of a core on which the crypt-sentence is to be wound when the encrypted sentence is decrypted by another party, and it may not be printed if the other party already knows it or can know it.

To have character orders of an input character string changed when outputting, a table of FIG. 23 stored in the ROM 41 is referenced to. The table of FIG. 23 has stored therein character orders of an input character string and character orders of an output character string in a corresponding manner. This table is an example for character strings having 8 characters, and there also provided tables for character numbers other than 8 characters.

FIG. 24 is an explanatory illustration of a concrete example in which orders for arrangement of characters of input and output character strings are converted by using the table of FIG. 23. Symbols at orders 3 and 6 in an input column and at orders 2 and 7 in an output column mean spaces. Data of a space input from a space key in the key-in section also is handled as one character.

Figure 25:
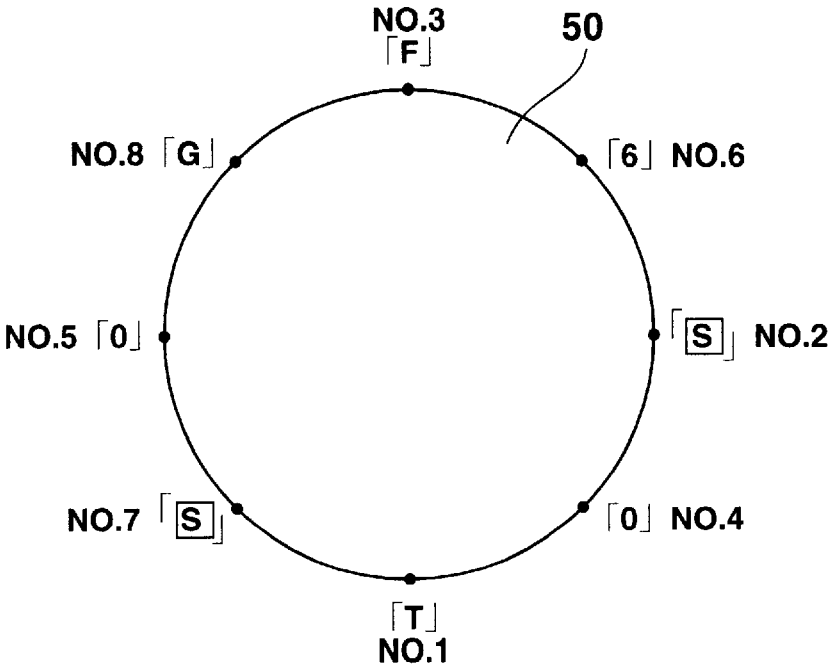
FIG. 25 is an explanatory diagram of character positions when the label of FIG. 21 is wound on an object.
Figure 26:
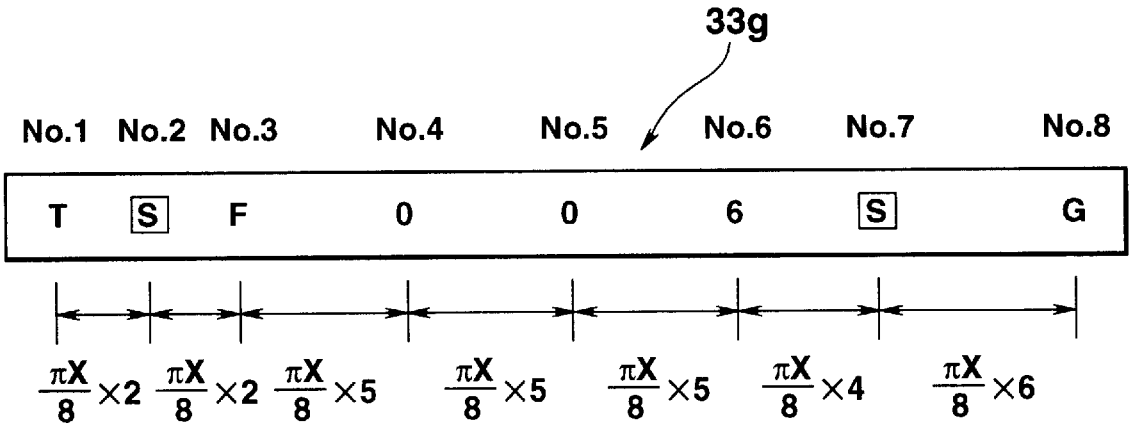
FIG. 26 is an explanatory illustration of character pitches of a string of characters or symbols on the label of FIG. 21.

Next, there will described control of an output character pitch. FIG. 25 is a diagram showing an arrangement for characters to appear on an outer circumference of a core (e.g., umbrella's grip 50 in FIG. 22) in a case the label 33*g* is wound on the core of a predetermined diameter X mm. Nos. represent output orders of an array of characters to be observed. FIG. 26 is an illustration showing character pitches of output characters on the label.

On the label 33*g* are output characters "T", "space", "F", "O", "O", "6", "space", and "G" in this order.

The characters have character pitches therebetween, as follows.

The first character "T" and the second character "space" have a character pitch $(\pi X/8)\times 2$, the second character "space" and the third character "F" have a character pitch $(\pi X/8)\times 2$, the third character "F" and the fourth character "O" have a character pitch $(\pi X/8)\times 5$, the fourth character "O" and the fifth character "O" have a character pitch $((\pi X/8)\times 5$, the fifth character "O" and the sixth character "6" have a character pitch $(\pi X/8)\times 5$, the sixth character "6" and the seventh character "space" have a character pitch $(\pi X/8)\times 4$, and the seven character "space" and the eighth character "G" have a character pitch $(\pi X/8)\times 6$.

These character pitch data are stored, as well, in advance in the ROM 41, in correspondence to the table of FIG. 23 or with the number of characters to be input.

On bases of the foregoing data, a printing is performed on the label 33*g*. In this example, the label 32*g* is wound by three and half turns around the object (umbrella's grip 50).

Incidentally, in this case, as the label 32*g* is temporarily wound on the object for decrypting the encrypted sentence formed of a string of characters, it is not always necessitated to provide an adhesive agent on a reverse side of the tape. To this point, in such a case as FIG. 22, if a name is printed on the label 32*g* for use as a name label to be affixed on an object, the tape may well have an adhesive agent on its reverse side.

Figure 27:
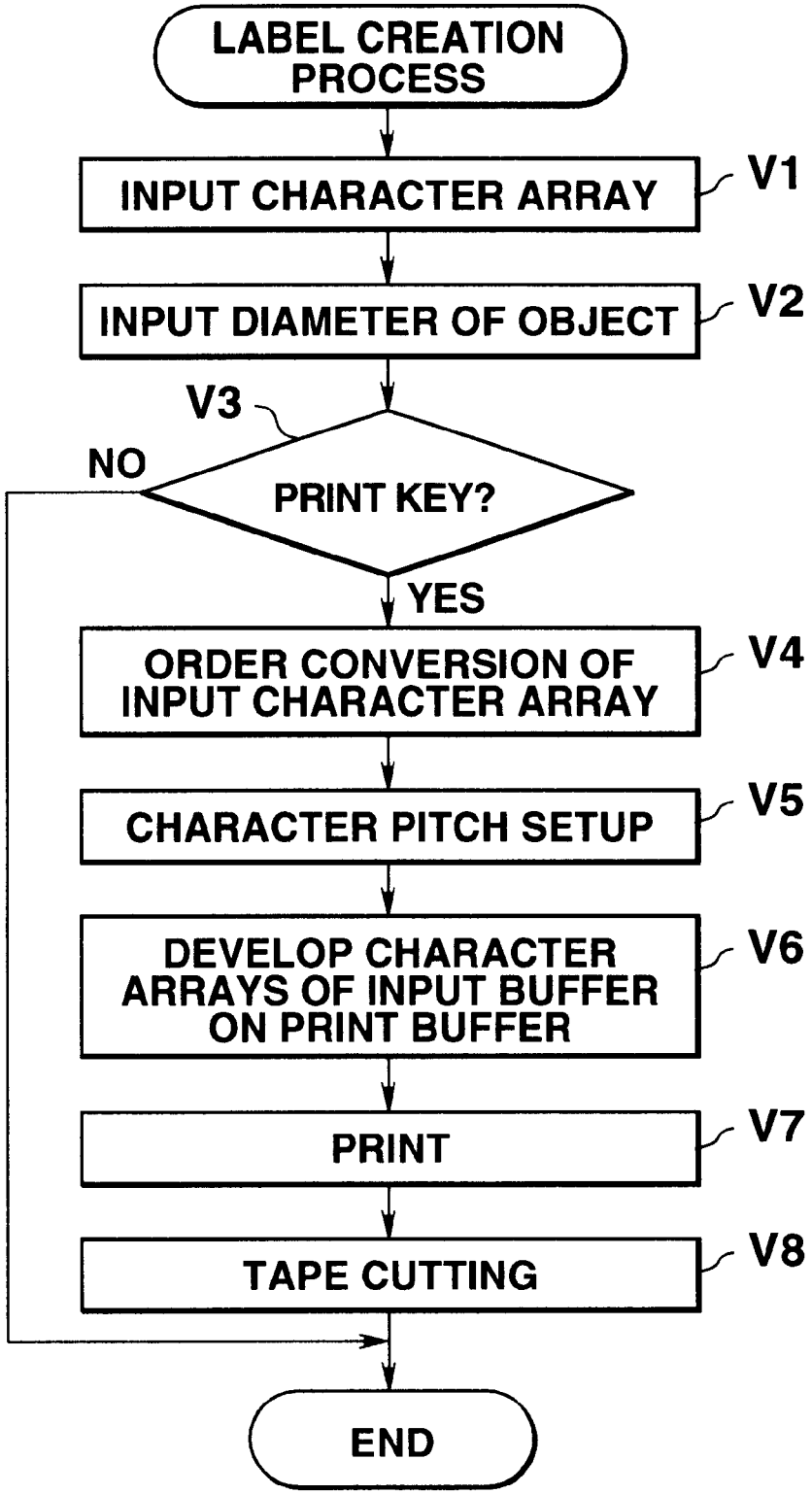
FIG. 27 is a flowchart showing a creation process of the label of FIG. 21.

FIG. 27 is a flowchart showing a creation process of the label of FIG. 21.

In FIG. 27, first, an input process is made of a string of characters to be printed. An input character string is stored in the input buffer 42*a* (step V1). In succession, a diameter of an object for a created label to be wound thereon is input. Input data is stored in the register 42*d* of the RAM 42. The configuration of the object is now assumed to be circular cylindrical (step V2). Then, as the print key is operated (step V3), the input character string has a changed order (step V4). In this process, first, the number of characters of the input character string is counted, with spaces inclusive, and in correspondence to a counted character number, a suitable table such as shown in FIG. 23 and stored in the ROM 41 is referenced to convert orders of the array of input characters in the buffer 42*a*.

Next, based on data on character pitches described with reference to FIG. 26 and stored in the ROM 41 in correspondence to the table or the character number, character pitches of respective order-converted characters are set at the register 42*d* of the RAM 42 (step V5).

Then, depending on the set character pitches, pattern data of the array of characters stored in the input buffer 42*a* with converted orders are developed on the print buffer 42*c* (step V6). Incidentally, at this time, for printing the numeric data set as to the object at the step V2, this data may be developed together. That is a character of X mm in FIG. 21 giving a hint for decrypting an encrypted character string.

Developed pattern data are transferred to the thermal head 9 (step V7), where they are printed on the tape 31 (step V8).

As described above, in this embodiment, the label 32*g* is allowed to have a simple encrypted sentence printed thereon for enjoyment.

Figure 28:
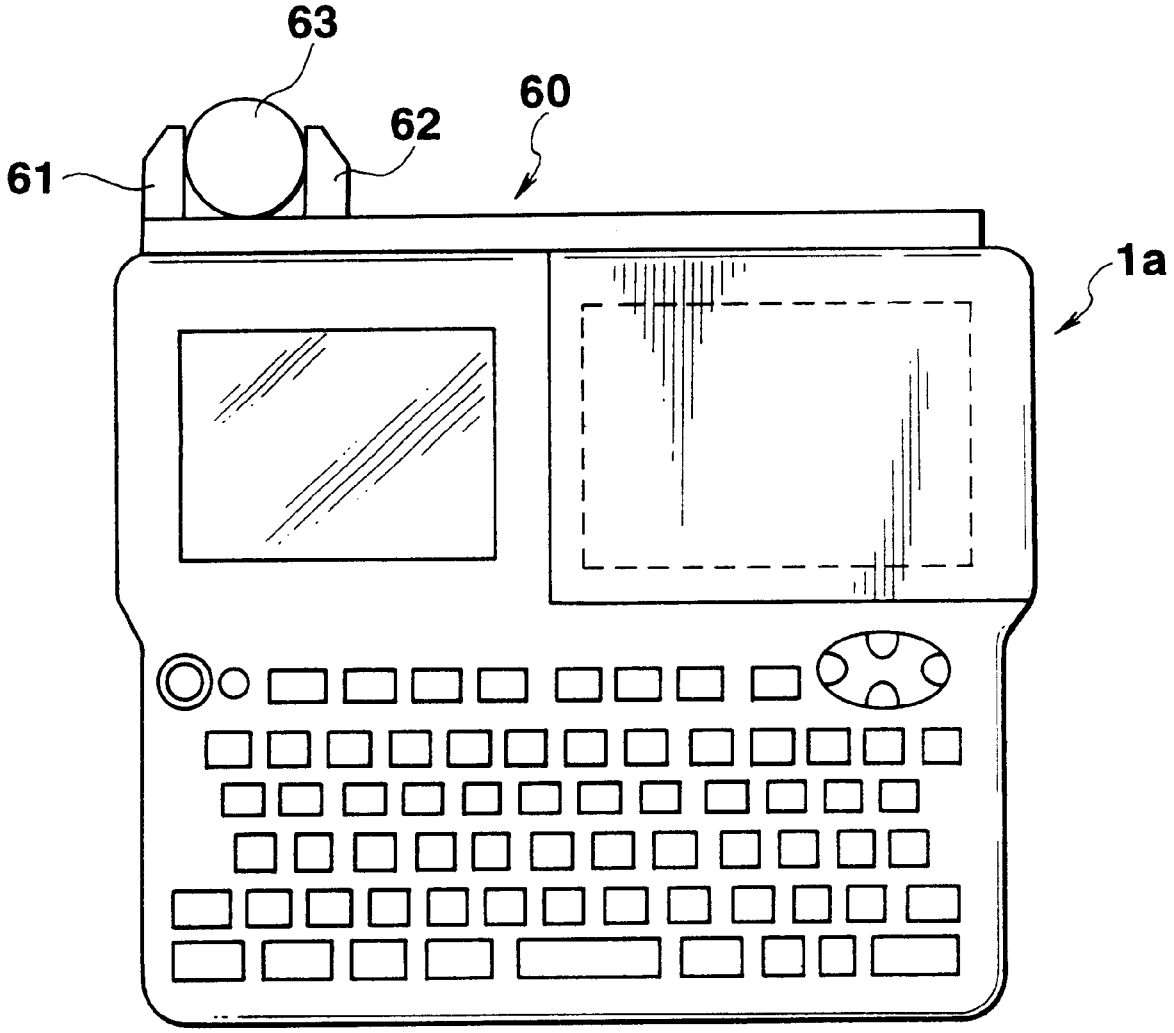
FIG. 28 is a plan view of another label printing apparatus.

FIG. 28 shows another label printing apparatus la equipped with an electronic caliper 60 for measurements of measuring dimensions of affix object shown in FIG. 10.

Figure 29:
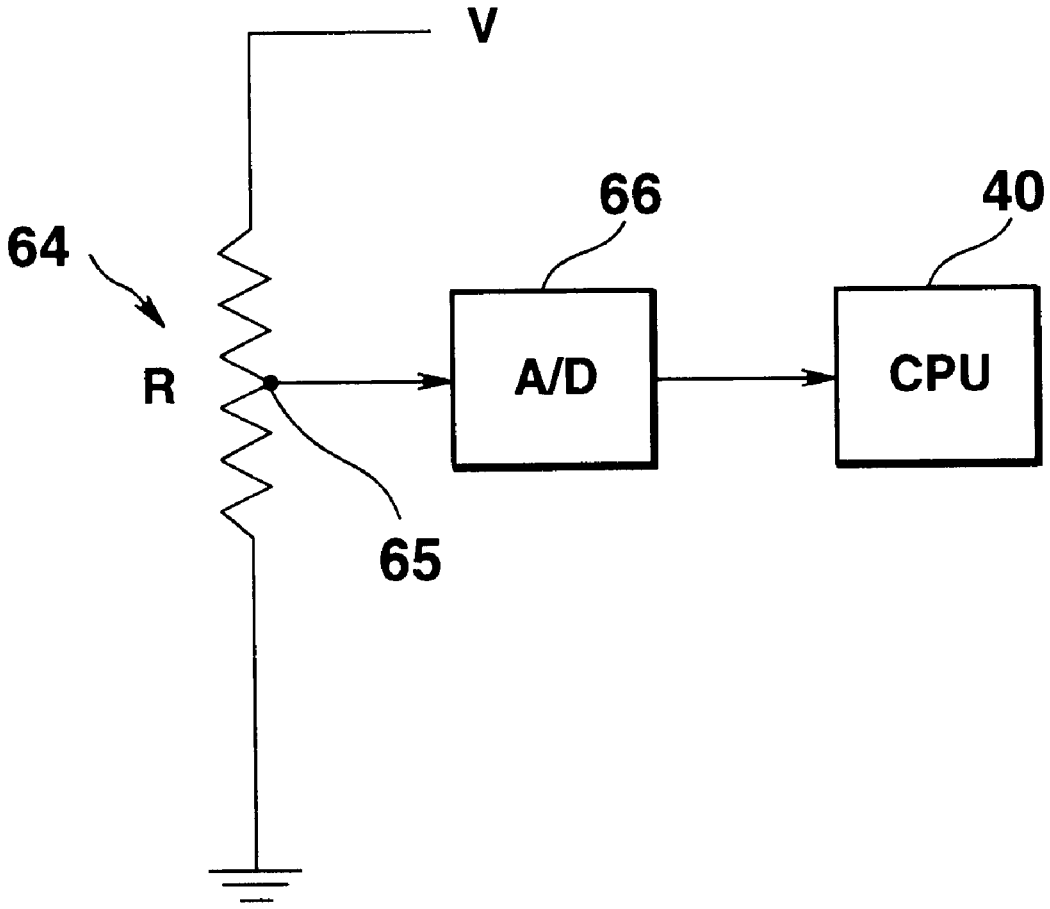
FIG. 29 is a circuit diagram of an electronic caliper.

FIG. 29 shows a circuit diagram of the electronic caliper 60. As in the Figure, it is constituted with a potentiometer 64, in which a terminal 65 is moved on a resistor R in correspondence to a movement of a mobile part 62 and a terminal 65 outputs a voltage in proportion to a position of the mobile part 62. The output voltage is converted by an A/D converter 66 into digital data, to be taken into the CPU 40 in an apparatus body. The measuring dimensions of the affix object are thereby allowed to be measured for automatic data input, which is convenient.

INDUSTRIAL APPLICABILITY

As described above, the present invention can provide a label printing apparatus for creating a label to be wound/affixed around an object, as a printed part to be cut out after a printing on an adequate length of part of a printing tape, wherein the label printing apparatus automatically determines a length of the label in accordance with a configuration of the object of winding/affix and a numeral value on a configuration-depending characteristic defining the configuration, and makes a printing such as for characters or symbols to be printed in an adequately arranging manner within the length.

Further, the present invention can provide a label printing apparatus adapted for creation of a variety of labels to be used by winding on an object.

What is claimed is:

1. A printing apparatus for creating a label to be wound on an object having a cross-section of one of a plurality of predetermined shapes, including a circular shape, a regular triangular shape and a regular square shape, the printing apparatus comprising:

a character input device that inputs a string of characters or symbols;

a tape carrier that carries a tape to be used to form the label;

a printing head adapted to print the input string of characters or symbols in a longitudinal direction of the tape;

a memory that stores arithmetic expressions to be used for calculating lengths of outer circumferences of a plurality of reference objects having cross-sections of the plurality of predetermined shapes, each predetermined shape having a particular length;

an information input device that specifies a shape of the cross-section of the object on which the label is to be wound, and that inputs a particular length corresponding to the specified shape;

a calculator that calculates a length of an outer circumference of the object on which the label is to be wound in accordance with the input particular length and the arithmetic expression of the reference object corresponding to the specified shape that is stored in the memory; and a printing control section that determines a printing size and pitch of the input string of characters or symbols such that the input string of characters or symbols is printed within a portion of the tape having the length calculated by the calculator, and that then controls the label to be created by driving the tape carrier and the printing head to print the input string of characters or symbols on the tape in accordance with the determined printing size and pitch.

2. The printing apparatus according to claim 1, further comprising a cutter that cuts the tape such that an overlap allowance is provided in addition to the calculated length of the label.

3. The printing apparatus according to claim 1, wherein said printing control section evenly allots a length of space which is obtained by subtracting a length of the input string of characters or symbols from the calculated length of the outer circumference of the object on which the label is to be wound, between adjacent two characters or symbols.

4. The printing apparatus according to claim 1, wherein said information input device comprises a measurement unit that measures the particular length of the object on which the label is to be wound.

5. The printing apparatus according to claim 1, wherein the tape comprises a print side and an affix side opposite to the print side.

6. The label printing apparatus according to claim 1, wherein said memory stores the following arithmetic expression for calculating the length of the outer circumference of a reference object having a circular cross-section using a diameter H4 of a circle: $\pi \times H4$.

7. A printing apparatus for creating a transparent label to be wound on an object a plurality of times, the printing apparatus comprising:

a character input device that inputs a string of characters or symbols;

a tape carrier that carries a tape to be used to form the label;

a printing head adapted to print the input string of characters or symbols in a longitudinal direction of the tape;

a first memory that stores an order conversion table indicating a relation between an input order of the characters or symbols of the input string and an output order of the characters or symbols of the input string;

a second memory that stores printing pitch data between respective characters or symbols which are output based on the output order stored in said memory, said printing pitch data being determined such that the input string of characters or symbols are arranged in the input character order when wound around the object a plurality of times; and a printing control section that converts the input string of characters or symbols based on the data of the character order stored in the first memory, and that then controls the string of characters or symbols to be printed on the tape based on the data of the character pitch stored in the second memory.

* * * * *